US009813793B2

(12) United States Patent
Harvey

(10) Patent No.: US 9,813,793 B2
(45) **Date of Patent: *Nov. 7, 2017**

(54) CANALPHONE SIZING SYSTEM AND METHOD

(71) Applicant: Jerry Harvey, Apopka, FL (US)

(72) Inventor: Jerry Harvey, Apopka, FL (US)

( * ) Notice: Subject to any disclaimer, the term of this patent is extended or adjusted under 35 U.S.C. 154(b) by 8 days.

This patent is subject to a terminal disclaimer.

(21) Appl. No.: 14/925,210

(22) Filed: Oct. 28, 2015

(65) Prior Publication Data

US 2016/0050478 A1 Feb. 18, 2016

Related U.S. Application Data

(63) Continuation-in-part of application No. 14/547,690, filed on Nov. 19, 2014, now Pat. No. 9,197,960, and a continuation-in-part of application No. 13/966,502, filed on Aug. 14, 2013, now Pat. No. 8,925,674, and a continuation-in-part of application No. 13/315,610, filed on Dec. 9, 2011, now Pat. No. 8,567,555.

(60) Provisional application No. 61/683,614, filed on Aug. 15, 2012.

(51) Int. Cl.

| | |
|---|---|
| ***H04R 5/02*** | (2006.01) |
| ***H04R 1/10*** | (2006.01) |
| ***H04R 1/24*** | (2006.01) |
| ***H04R 3/04*** | (2006.01) |
| *H04R 3/14* | (2006.01) |

(52) U.S. Cl.

CPC ..... *H04R 1/1016* (2013.01); *H04R 1/24* (2013.01); *H04R 3/04* (2013.01); *H04R 1/1075* (2013.01); *H04R 3/14* (2013.01)

(58) Field of Classification Search

USPC ..... 318/339

See application file for complete search history.

(56) References Cited

U.S. PATENT DOCUMENTS

| | | | | |
|---|---|---|---|---|
| 7,194,102 | B2 * | 3/2007 | Harvey | H04R 1/1016 381/324 |
| 7,489,794 | B2 * | 2/2009 | Harvey | H04R 1/22 381/322 |
| 8,194,911 | B2 * | 6/2012 | Dyer | H04R 1/1016 181/135 |
| 8,567,555 | B2 * | 10/2013 | Harvey | H04R 1/1016 181/129 |
| 8,925,674 | B2 * | 1/2015 | Harvey | H04R 3/00 181/135 |
| 9,197,960 | B2 * | 11/2015 | Harvey | H04R 3/00 |
| 2006/0133631 | A1 * | 6/2006 | Harvey | H04R 1/1016 381/312 |
| 2006/0133636 | A1 * | 6/2006 | Harvey | H04R 1/1016 381/380 |
| 2007/0036385 | A1 * | 2/2007 | Harvey | H04R 1/2819 381/388 |

(Continued)

*Primary Examiner* — Forrest M Phillips

(74) *Attorney, Agent, or Firm* — Douglas J Visnius

(57) ABSTRACT

A canalphone system may include a canalphone housing, and a low frequency sound bore to carry a low frequency signal to the canalphone housing's outside. The system may also include a high frequency sound bore to carry a high frequency signal to the canalphone housing's outside, and the low frequency sound bore's length and/or the high frequency sound bore's length determined based upon being acoustically proper as well as a user's ear canal size.

20 Claims, 27 Drawing Sheets

(56) References Cited

U.S. PATENT DOCUMENTS

2007/0223735 A1* 9/2007 LoPresti ..... H04R 1/24
381/99
2011/0293112 A1* 12/2011 Harvey ..... H04R 1/1016
381/99

* cited by examiner

CANALPHONE SIZING SYSTEM AND METHOD

CROSS-REFERENCE TO RELATED APPLICATIONS

This application is a continuation-in-part of copending U.S. patent application Ser. No. 14/547,690, filed Nov. 19, 2014, which was a continuation-in-part of U.S. patent application Ser. No. 13/966,502, filed Aug. 14, 2013, which was a continuation-in-part of U.S. patent application Ser. No. 13/315,610, filed Dec. 9, 2011, and that also claimed the benefit of U.S. Provisional Application No. 61/683,614, filed Aug. 15, 2012. The present application and both applications identified above include identical inventorship and ownership.

BACKGROUND

The embodiments relate to the field of canalphones and/or similar listening devices.

There are many different types of personal listening devices such as headphones, earbuds, canalphones, and/or the like. Headphones are personal listening devices that are held in close proximately to the ear by some support system. Earbuds are small personal listening devices that are positioned directly in front of the ear canal and are substantially smaller than a person's outer ear. Similarly, canalphones are personal listening devices that are substantially smaller than a person's outer ear, but they differ from earbuds in that they are placed directly in one end of the ear canal. Both earbuds and canalphones are held in positioned by friction between the ear and the device rather than the support system found in most headphones. Canalphones may also be held in place by retainers that engage a portion of the listener's head.

Canalphones are also referred to as in-ear monitors due to how the canalphone is worn by a listener. In other words, a canalphone housing is worn in the ear of the user and not over and/or around the ear of the user. Some canalphones also serve as earplugs due to the way the canalphone limits noise external to the canalphone from entering the ear canal.

SUMMARY

According to one embodiment, a canalphone system may include a high frequency sound bore carried within a canalphone. The system may also include a low frequency sound bore carried within the canalphone that is adjacent to the high frequency sound bore to form a single unit prior to the sound bores being introduced to the canalphone, the low frequency sound bore and the high frequency sound bore being sized so that the low frequency sound bore and the high frequency sound bore each deliver sound with correct time and phase. The system may further include a high acoustical driver carried within the canalphone where the high acoustical driver delivers sound through the high frequency sound bore. The system may additionally include a low acoustical driver carried within the canalphone where the low acoustical driver delivers sound through the low frequency sound bore.

The low acoustical driver may comprise two low acoustical drivers. The high acoustical driver may comprise two high acoustical drivers.

The low frequency sound bore and/or the high frequency sound bore may carry an acoustical damper. The acoustical damper may be positioned without any rubber boot.

The low frequency sound bore and/or the high frequency sound bore may have extended lengths to reduce each sound bore's diameter. The high frequency sound bore's extended length may be greater than 3 millimeters.

The single unit may aid in the assembly of the canalphone. The single unit may be positioned at an angle between 30 degrees and 65 degrees with respect to the high acoustical driver and the low acoustical driver. The system may further include a resistor on the high acoustical driver to tune the high acoustical driver.

In another embodiment, the system may include a high frequency sound bore carried within a canalphone. The system may also include a low frequency sound bore carried within the canalphone that is adjacent to the high frequency sound bore to form a single unit prior to the sound bores being introduced to the canalphone, the low frequency sound bore and the high frequency sound bore being sized so that the low frequency sound bore and the high frequency sound bore each deliver sound with correct time and phase, and where the low frequency sound bore and the high frequency sound bore have extended lengths to reduce each sound bore's diameter. The system may further include a high acoustical driver carried within the canalphone where the high acoustical driver delivers sound through the high frequency sound bore. The system may additionally include a low acoustical driver carried within the canalphone where the low acoustical driver delivers sound through the low frequency sound bore, and the single unit is positioned at an angle between 30 degrees and 65 degrees with respect to the high acoustical driver and the low acoustical driver.

Another aspect of the embodiments is a method. The method may include positioning a high acoustical driver within a canalphone. The method may also include positioning a low acoustical driver within the canalphone adjacent to the high acoustical driver. The method may further include positioning a single unit comprising a low frequency sound bore adjacent to a high frequency sound bore within the canalphone where the low frequency sound bore and the high frequency sound bore are sized so that the low frequency sound bore and the high frequency sound bore each deliver sound with correct time and phase, and the single unit adjoins both the high acoustical driver and low acoustical driver.

The method may additionally include inserting an acoustical damper within at least one of the low frequency sound bore and the high frequency sound bore. The method may also include inserting the acoustical damper within the sound bore without any rubber boot. The method may further include reducing the low frequency sound bore's diameter and the high frequency sound bore's diameter by extending the lengths of each sound bore.

According to another embodiment, a canalphone system may include a high audio driver carried by a canalphone housing, and a low audio driver carried by the canalphone housing adjacent to the high audio driver. The system may also include an acoustical-timer to phase correct a high audio signal from the high audio driver directed to the outside of the canalphone housing with delivery of a low audio signal from the low audio driver directed to the outside of the canalphone housing.

The acoustical-timer further includes a low audio sound-tube to carry a low audio signal from the low audio driver to outside of the canalphone housing, and a high audio sound-tube to carry a high audio signal from the high audio driver to the outside of the canalphone housing, the high audio sound-tube phase corrected with respect to the low audio sound-tube by sizing it to be longer than the low audio sound-tube. The low audio sound-tube may be sized based upon its time response for the low audio signal to pass through the low audio sound-tube.

The high audio sound-tube may be longer to slow down the high audio signal's arrival to the outside of the canalphone housing so that it is closer in time to the low audio signal from the low audio driver arrival to the outside of the canalphone housing. The arrival of the high audio signal's to the outside of the canalphone housing is less than 0.05 milliseconds difference than the low audio signal from the low audio driver arrival to the outside of the canalphone housing.

The system may additionally include a mid audio driver carried by the canalphone housing adjacent to the high audio driver, and a mid audio sound-tube to carry a mid-audio signal from the mid audio driver to the outside of the canalphone housing, the mid audio sound-tube phase corrected by sizing it to be longer than the low audio sound-tube and shorter than the high audio sound-tube. The acoustical-timer may include a processor to phase correct a high audio signal from the high audio driver to the outside of the canalphone housing with delivery of a low audio signal from the low audio driver to the outside of the canalphone housing.

The processor may use digital signal processing to control the high audio signal's arrival at the outside of the canalphone housing to be closer in time to the low audio signal from the low audio driver's arrival to the outside of the canalphone housing. The arrival of the high audio signal's to the outside of the canalphone housing is less than 0.05 milliseconds difference than the low audio signal from the low audio driver arrival to the outside of the canalphone housing.

The acoustical-timer may use a time response for the low audio signal to pass through the canalphone housing as a control point to set all other audio signals' phase in the system. The system may also include a mid audio driver carried by the canalphone housing adjacent to the high audio driver, the mid audio driver to provide a mid-audio signal to the outside of the canalphone housing based upon the low audio driver.

Another aspect of the embodiments is another method. The method may include providing a high audio driver carried by a canalphone housing, and a low audio driver carried by the canalphone housing adjacent to the high audio driver. The method may also include phase correcting a high audio signal from the high audio driver directed to the outside of the canalphone housing with delivery of a low audio signal from the low audio driver directed to the outside of the canalphone housing.

The method may further include carrying a low audio signal from the low audio driver to outside of the canalphone housing via a low audio sound-tube, and carrying a high audio signal from the high audio driver to the outside of the canalphone housing via a high audio sound-tube phase corrected with respect to the low audio sound-tube by sizing it to be longer than the low audio sound-tube. The method may additionally include sizing the low audio sound-tube based upon its time response for the low audio signal to pass through the low audio sound-tube.

The method may also include selecting the low audio sound-tube's size to be acoustically proper and as short as can be readily fit into the canalphone housing. The method may further include slowing down the high audio signal's arrival to the outside of the canalphone housing so that it is closer in time to the low audio signal from the low audio driver arrival to the outside of the canalphone housing by making the high audio sound-tube longer.

The method may additionally include timing the arrival of the high audio signal to the outside of the canalphone housing compared to the low audio signal from the low audio driver arrival to the outside of the canalphone housing is within 0.05 milliseconds of each other. The method may also include using digital signal processing to phase correct a high audio signal from the high audio driver directed to the outside of the canalphone housing with delivery of a low audio signal from the low audio driver directed to the outside of the canalphone housing.

The method may further include timing the arrival of the high audio signal to the outside of the canalphone housing compared to the low audio signal from the low audio driver arrival to the outside of the canalphone housing is within 0.05 milliseconds of each other. The method may additionally include using a time response for the low audio signal to pass through the canalphone housing as a control point to set all other audio signals' phase in the system.

The method may also include standardizing high audio sound-tube lengths based upon at least two low sound-tube lengths. The method may further include fabricating an assembly of a standardized high audio sound-tube length with a respective one of the two low audio sound-tube lengths to make installation in the canalphone housing easier and to provide repeatable acoustic characteristics. The method may additionally include aligning the standardized high audio sound-tube length's end with the respective one of the two low audio sound-tube lengths' end.

Another embodiment is computer readable program codes coupled to tangible media to provide canalphone phase correction. The computer readable program codes may be configured to cause the program to provide a high audio driver carried by a canalphone housing, and a low audio driver carried by the canalphone housing adjacent to the high audio driver. The computer readable program codes may also be configured to cause the program to phase correct a high audio signal from the high audio driver to the outside of the canalphone housing with delivery of a low audio signal from the low audio driver to the outside of the canalphone housing. The computer program product may further include program code configured to phase correct a high audio signal from the high audio driver to the outside of the canalphone housing with delivery of a low audio signal from the low audio driver to the outside of the canalphone housing.

According to one embodiment, a canalphone system may include a canalphone housing, and a low frequency sound bore to carry a low frequency signal to the canalphone housing's outside. The system may also include a high frequency sound bore to carry a high frequency signal to the canalphone housing's outside, and the low frequency sound bore's length and/or the high frequency sound bore's length may be determined based upon being acoustically proper as well as a user's ear canal size.

The system may further include the low frequency sound bore's length and/or the high frequency sound bore's length being extended to reduce a respective low frequency sound bore's diameter and/or high frequency sound bore's diameter. The low frequency sound bore may be sized based upon the low frequency signal's time response to pass through the low frequency sound bore.

The high frequency sound bore may be longer to slow down the high frequency signal's arrival to the outside of the canalphone housing so that it is closer in time to the low frequency signal's arrival to the outside of the canalphone housing. The low frequency sound bore's diameter and/or the high frequency sound bore's diameter may be varied to fit a respective small, medium, and large canalphone housing.

The low frequency sound bore and the high frequency sound bore may be joined as a single unit. The single unit may be positioned at an angle between 30 degrees and 65 degrees with respect to a high acoustical driver and a low acoustical driver. The system may also include a mid-frequency sound bore sized between the low frequency sound bore and the high frequency sound bore.

Another aspect of the embodiments is a method. The method may include determining a user's ear canal size. The method may also include determining a low frequency sound bore's length and/or a high frequency sound bore's length based upon being acoustically proper as well as the user's ear canal size.

The method may further include extending the low frequency sound bore's length and/or the high frequency sound bore's length to reduce a respective low frequency sound bore's diameter and/or high frequency sound bore's diameter. The method may also include sizing the low frequency sound bore based upon the low frequency signal's time response to pass through the low frequency sound bore.

The method may additionally include making the high frequency sound bore longer to slow down the high frequency signal's arrival to the outside of a canalphone housing so that it is closer in time to the low frequency signal's arrival to the outside of the canalphone housing. The method may also include varying the low frequency sound bore's diameter and/or the high frequency sound bore's diameter to fit a respective small, medium, and large canalphone housing.

The method may further include combining a low frequency sound bore and a high frequency sound bore as a single unit, and installing the single unit into a canalphone housing. The method may additionally include positioning the single unit at an angle between 30 degrees and 65 degrees with respect to a high acoustical driver and a low acoustical driver. The method may also include making a low frequency sound bore and a high frequency sound bore an inbuilt part of a canalphone housing.

DETAILED DESCRIPTION

Embodiments will now be described more fully hereinafter with reference to the accompanying drawings, in which preferred embodiments are shown. Like numbers refer to like elements throughout.

Figure 1:
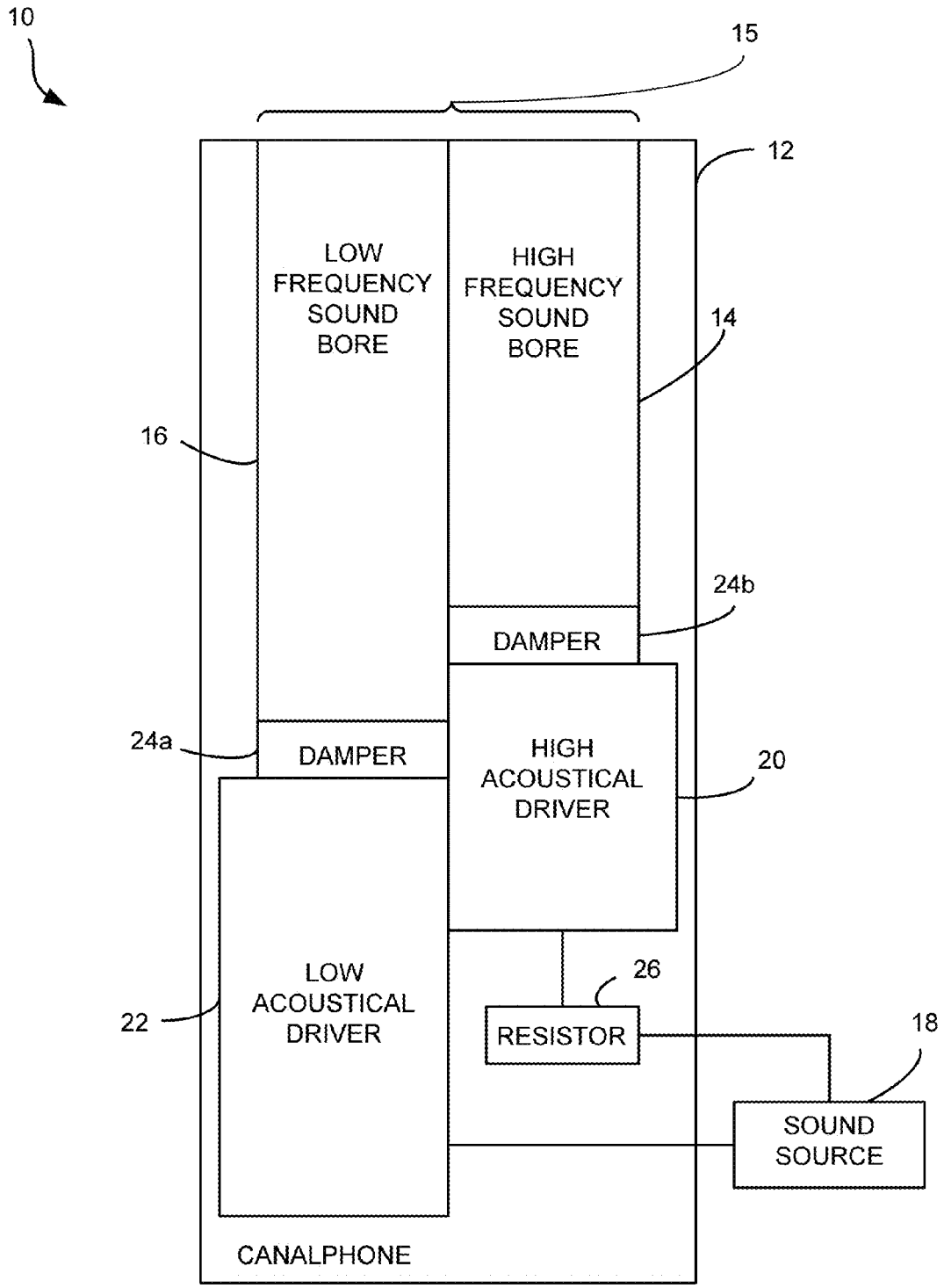
FIG. 1 is a schematic block diagram of a system in accordance with the embodiments.

With reference now to FIG. 1, a dual bore canalphone system 10 is initially described. The system 10 is carried by a canalphone housing 12 that frictionally engages the ear of a user (not shown) in its usage position as will be appreciated by those of skill in the art.

In one embodiment, the system 10 includes a high frequency sound bore 14 carried within the canalphone 12. The system 10 also include a low frequency sound bore 16 carried within the canalphone 12 that is adjacent to the high frequency sound bore 14 to form a single unit 15 prior to the sound bores being introduced to the canalphone, the low frequency sound bore and the high frequency sound bore being sized so that the low frequency sound bore and the high frequency sound bore each deliver sound 18 with correct time and phase.

For example, the sizing of the low frequency sound bore 16 and the high frequency sound bore 14 involves selecting the diameter and/or length of each sound bore to provide the correct time and phase of sound 18 through the two sound bores with respect to each other. In other words, correct time and phase of the sound 18 through the low frequency sound bore 16 and the high frequency sound bore 14 as acoustically perceived by one using the system 10.

The system 10 further includes a high acoustical driver 20 carried within the canalphone where the high acoustical driver delivers sound 18 through the high frequency sound bore 14. The system 10 additionally include a low acoustical driver 22 carried within the canalphone 12 where the low acoustical driver delivers sound 18 through the low frequency sound bore.

In one embodiment, the low acoustical driver 22 comprises two low acoustical drivers. In another embodiment, the high acoustical driver 20 comprises two high acoustical drivers.

In one embodiment, the low frequency sound bore 16 and/or the high frequency sound bore 14 carry an acoustical damper 24*a* and 24*b*. In another embodiment, the acoustical damper 24*a* and 24*b* is positioned without any rubber boot (not shown).

In one embodiment, the low frequency sound bore 16 and/or the high frequency sound bore 14 have extended lengths to reduce each sound bore's diameter. Stated another way, the acoustical characteristics of either bore is preserved when reducing the bore's diameter by extending the bore's overall length. An advantage of the reduction of the two bores' diameter is that a user of system 10 can have a physically smaller ear canal. Stated another way, a physically smaller person usually has a smaller ear canal than a physically larger person, and system 10 can properly fit the physically smaller ear canal because of its reduced bore diameters while other canalphone systems currently available do not fit such individuals. In another embodiment, the high frequency sound bore's 14 extended length is greater than 3 millimeters.

In one embodiment, the single unit 15 aids in the assembly of the canalphone. Stated another way, because the single unit 15 is one piece, the installation of the single unit into the canalphone 12 is easier than trying to install the low frequency sound bore 16 and the high frequency sound bore 14 as separate components. In another embodiment, the single unit 15 is positioned at an angle between 30 degrees and 65 degrees with respect to the high acoustical driver 20 and the low acoustical driver 22. In another embodiment, the system 10 includes a resistor 26 on the high acoustical driver 20 to tune the high acoustical driver.

In another embodiment, the system 10 includes a high frequency sound bore 14 carried within the canalphone 12. The system also includes a low frequency sound bore 16 carried within the canalphone 12 that is adjacent to the high frequency sound bore 14 to form a single unit 15 prior to the sound bores being introduced to the canalphone, the low frequency sound bore and the high frequency sound bore being sized so that the low frequency sound bore and the high frequency sound bore each deliver sound 18 with correct time and phase, and where the low frequency sound bore and the high frequency sound bore have extended lengths to reduce each sound bore's diameter. The system further includes a high acoustical driver 20 carried within the canalphone 12 where the high acoustical driver delivers sound 18 through the high frequency sound bore 14. The system additionally include a low acoustical driver 22 carried within the canalphone 22 where the low acoustical driver delivers sound 18 through the low frequency sound bore 16, and the single unit 15 is positioned at an angle between 30 degrees and 65 degrees with respect to the high acoustical driver 14 and the low acoustical driver.

Figure 2:
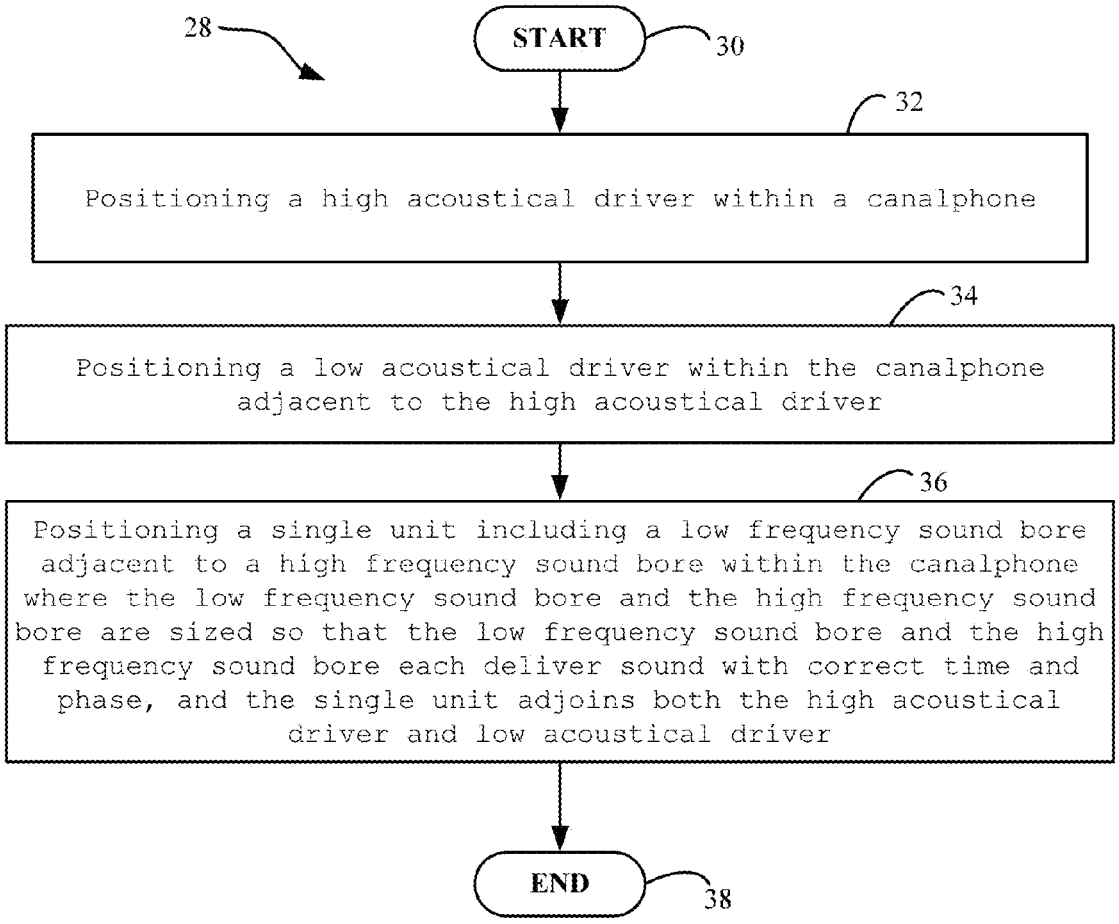
FIG. 2 is a flowchart illustrating method aspects according to the embodiments.

Another aspect of the embodiments is a method, which is now described with reference to flowchart 28 of FIG. 2. The method begins at Block 30 and may include positioning a high acoustical driver within a canalphone at Block 32. The method may also include positioning a low acoustical driver within the canalphone adjacent to the high acoustical driver at Block 34. The method may further include positioning a single unit including a low frequency sound bore adjacent to a high frequency sound bore within the canalphone where the low frequency sound bore and the high frequency sound bore are sized so that the low frequency sound bore and the high frequency sound bore each deliver sound with correct time and phase, and the single unit adjoins both the high acoustical driver and low acoustical driver at Block 36. The method ends at Block 38.

Figure 3:
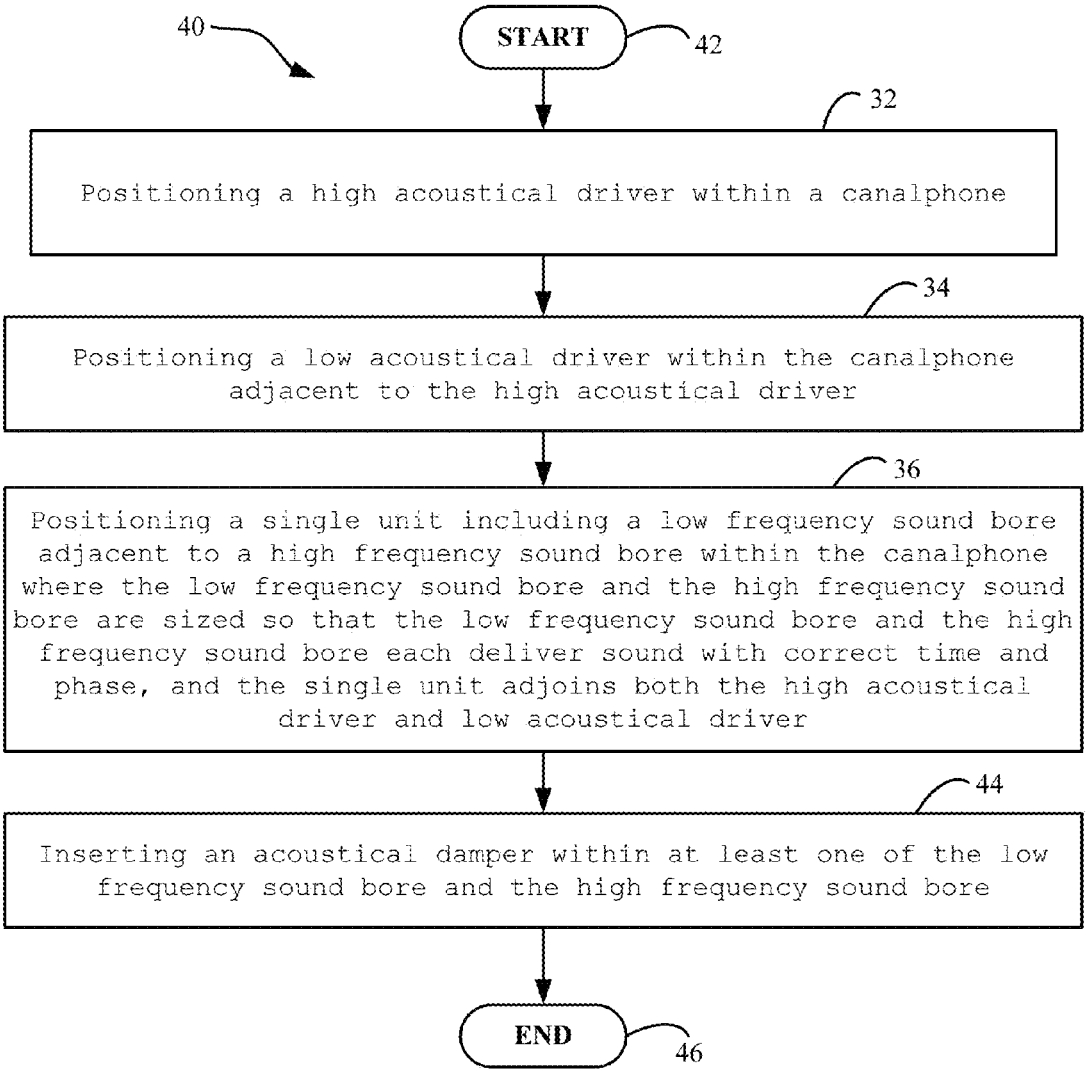
FIG. 3 is a flowchart illustrating method aspects according to the method of FIG. 2.

In another method embodiment, which is now described with reference to flowchart 40 of FIG. 3, the method begins at Block 42. The method may include the steps of FIG. 2 at Blocks 32, 34, and 36. The method may further include inserting an acoustical damper within at least one of the low frequency sound bore and the high frequency sound bore at Block 44. The method ends at Block 46.

Figure 4:
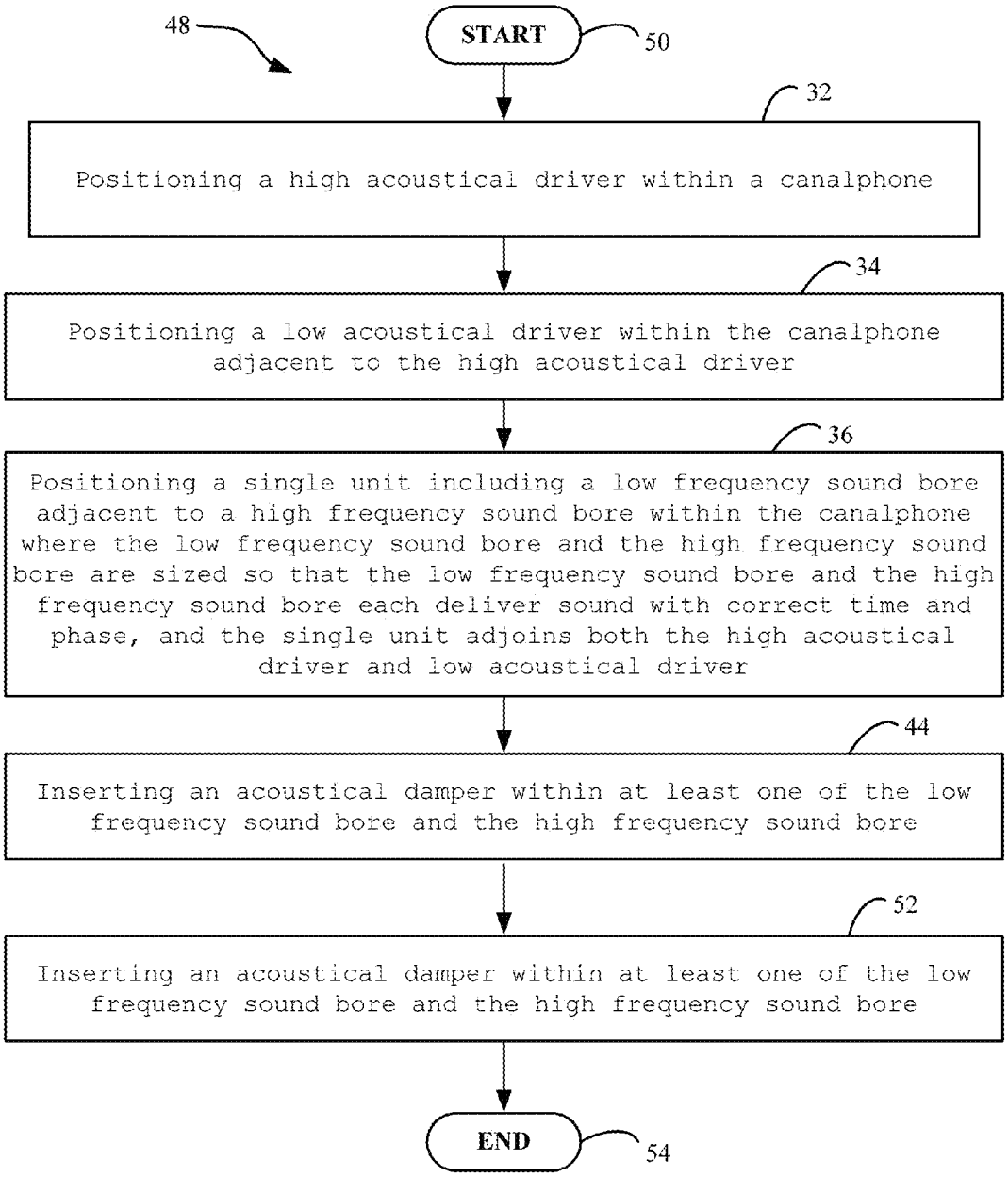
FIG. 4 is a flowchart illustrating method aspects according to the method of FIG. 3.

In another method embodiment, which is now described with reference to flowchart 48 of FIG. 4, the method begins at Block 50. The method may include the steps of FIG. 3 at Blocks 32, 34, 36, and 44. The method may also include inserting the acoustical damper within the sound bore without any rubber boot at Block 52. The method ends at Block 54.

Figure 5:
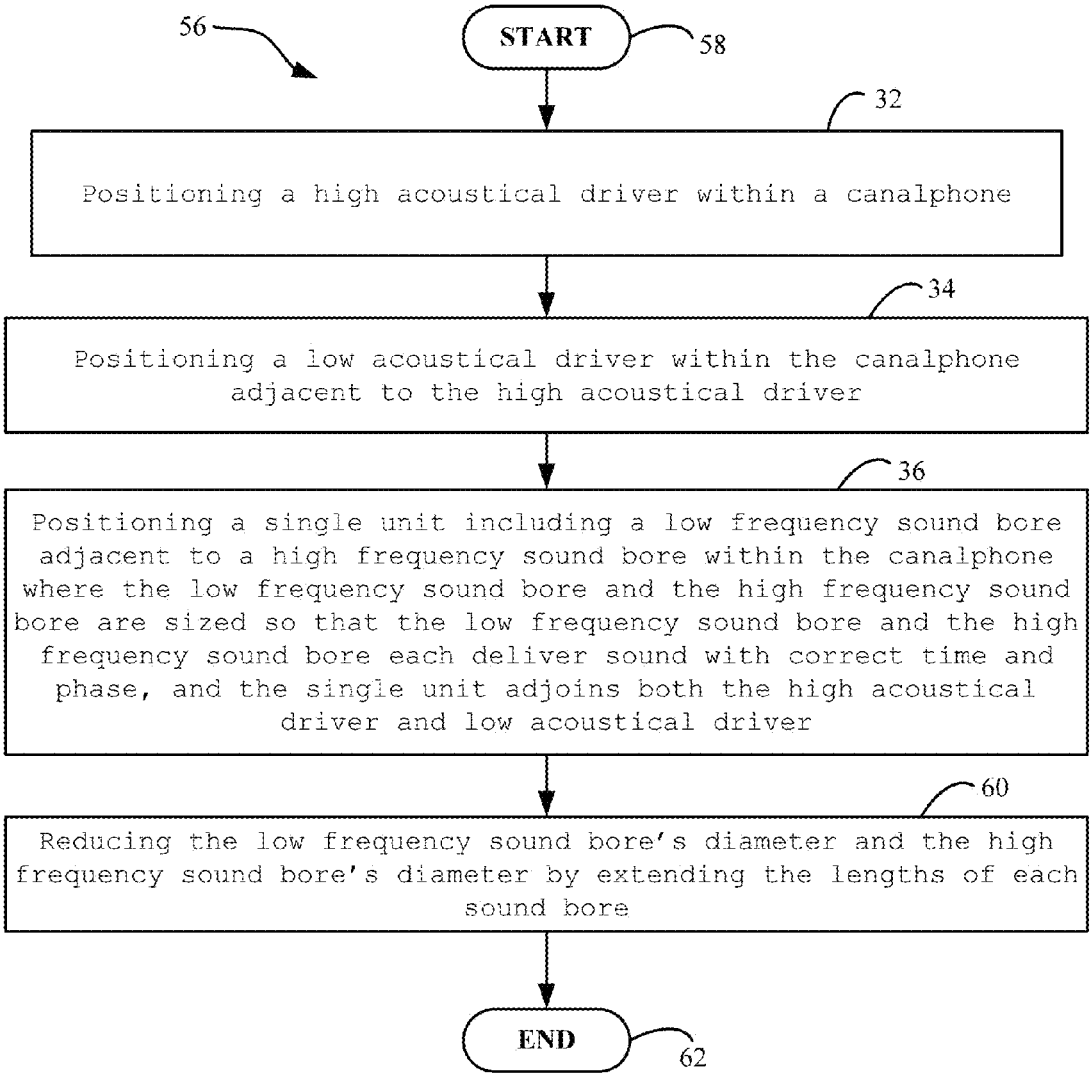
FIG. 5 is a flowchart illustrating method aspects according to the method of FIG. 2.

In another method embodiment, which is now described with reference to flowchart 56 of FIG. 5, the method begins at Block 58. The method may include the steps of FIG. 2 at Blocks 32, 34, and 36. The method may further include reducing the low frequency sound bore's diameter and the high frequency sound bore's diameter by extending the lengths of each sound bore at Block 60. The method ends at Block 62.

Figure 6:
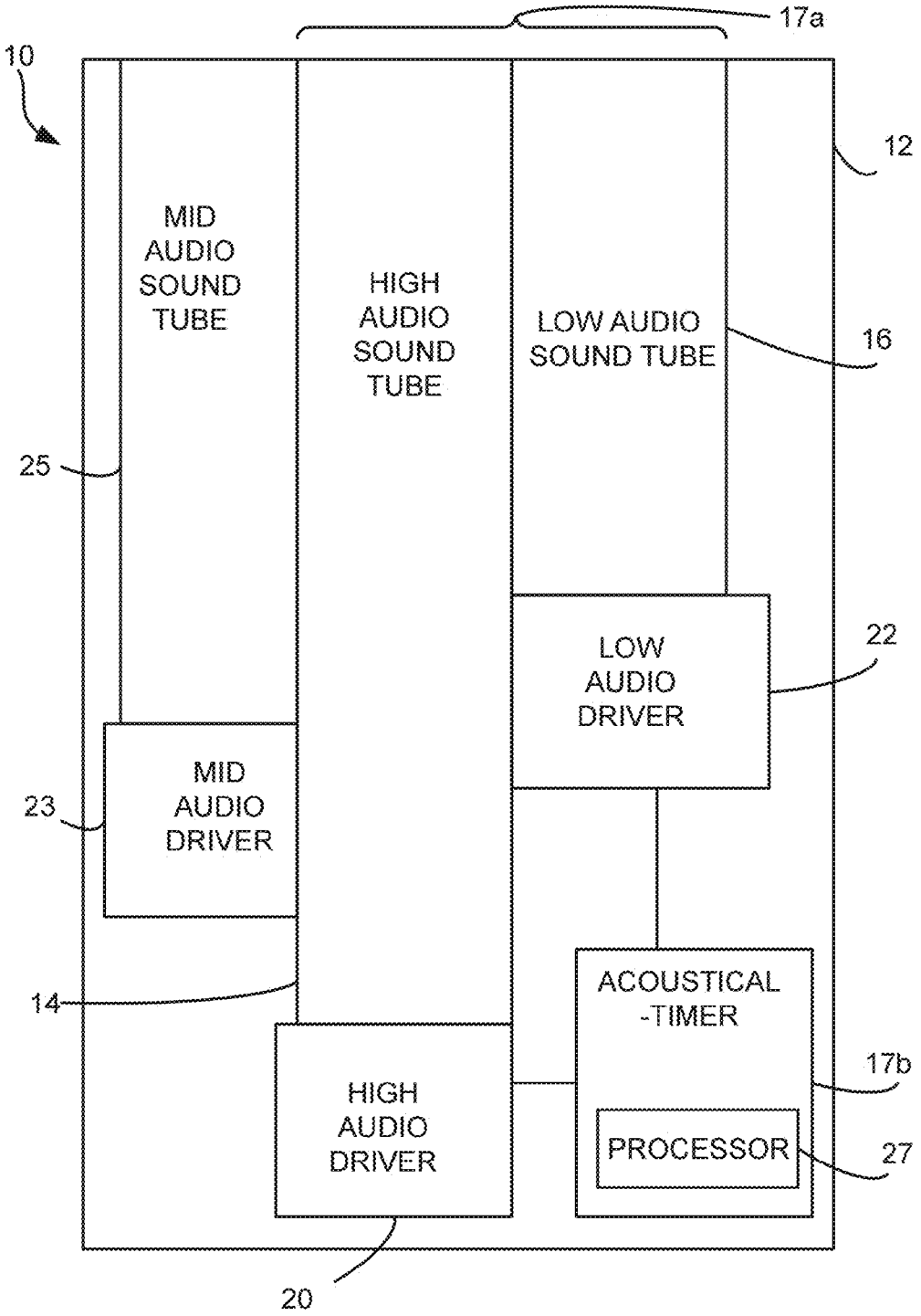
FIG. 6 is a schematic block diagram of a system in accordance with various embodiments.

With reference now to FIG. 6, a phase corrected canalphone system 10 is further described. In one embodiment, the system 10 includes a canalphone housing 12 that frictionally engages the ear of a user (not shown) in its usage position.

In one embodiment, the system 10 includes a high audio driver 20 carried by the canalphone housing 12, and a low audio driver 22 carried by the canalphone housing adjacent to the high audio driver. In another embodiment, the system 10 also includes an acoustical-timer 17*a* and/or 17*b* to phase correct a high audio signal from the high audio driver 20 directed to the outside of the canalphone housing 12 with delivery of a low audio signal from the low audio driver 22 directed to the outside of the canalphone housing.

In one embodiment, the acoustical-timer 17*a* includes a low audio sound-tube 16 to carry a low audio signal from the low audio driver 22 to the outside of the canalphone housing 12. In another embodiment, the acoustical-timer 17*a* further includes a high audio sound-tube 14 to carry a high audio signal from the high audio driver 20 to the outside of the canalphone housing 12, the high audio sound-tube phase corrected with respect to the low audio sound-tube 16 by sizing it to be longer than the low audio sound-tube.

In one embodiment, the low audio sound-tube 16 is sized based upon its time response for the low audio signal to pass through the low audio sound-tube. In another embodiment, the high audio sound-tube 14 is longer to slow down the high audio signal's arrival to the outside of the canalphone housing 12 so that it is closer in time to the low audio signal from the low audio driver's 22 arrival to the outside of the canalphone housing.

In one embodiment, the arrival of the high audio signal to the outside of the canalphone housing 12 is less than 0.05 milliseconds difference than the low audio signal from the low audio driver's 22 arrival to the outside of the canalphone housing. In another embodiment, the difference is less than 0.02 milliseconds difference.

In one embodiment, the system 10 additionally includes a mid audio driver 23 carried by the canalphone housing 12 adjacent to the high audio driver 20, and a mid audio sound-tube 25 to carry a mid-audio signal from the mid audio driver to the outside of the canalphone housing, the mid audio sound-tube phase corrected by sizing it to be longer than the low audio sound-tube 16 and shorter than the high audio sound-tube 14.

In one embodiment, the acoustical-timer 17*b* includes a processor 27 to phase correct a high audio signal from the high audio driver 20 directed to the outside of the canalphone housing 12 with delivery of a low audio signal from the low audio driver 22 directed to the outside of the canalphone housing. In another embodiment, the processor 27 uses digital signal processing to control the high audio signal's arrival at the outside of the canalphone housing 12 to be closer in time to the low audio signal from the low audio driver's 16 arrival to the outside of the canalphone housing.

In one embodiment, the arrival of the high audio signal to the outside of the canalphone housing 12 is less than 0.05 milliseconds difference compared to the low audio signal from the low audio driver's 16 arrival to the outside of the canalphone housing. In another embodiment, the acoustical-timer 17*a* and 17*b* uses a time response for the low audio signal to pass through the canalphone housing 12 as a control point to set all other audio signals' phase in the system 10. In another embodiment, the system 10 further includes a mid audio driver 23 carried by the canalphone housing 12 adjacent to the high audio driver 20, and the mid audio driver provides a mid-audio signal to the outside of the canalphone housing based upon the low audio driver 22.

Figure 7:
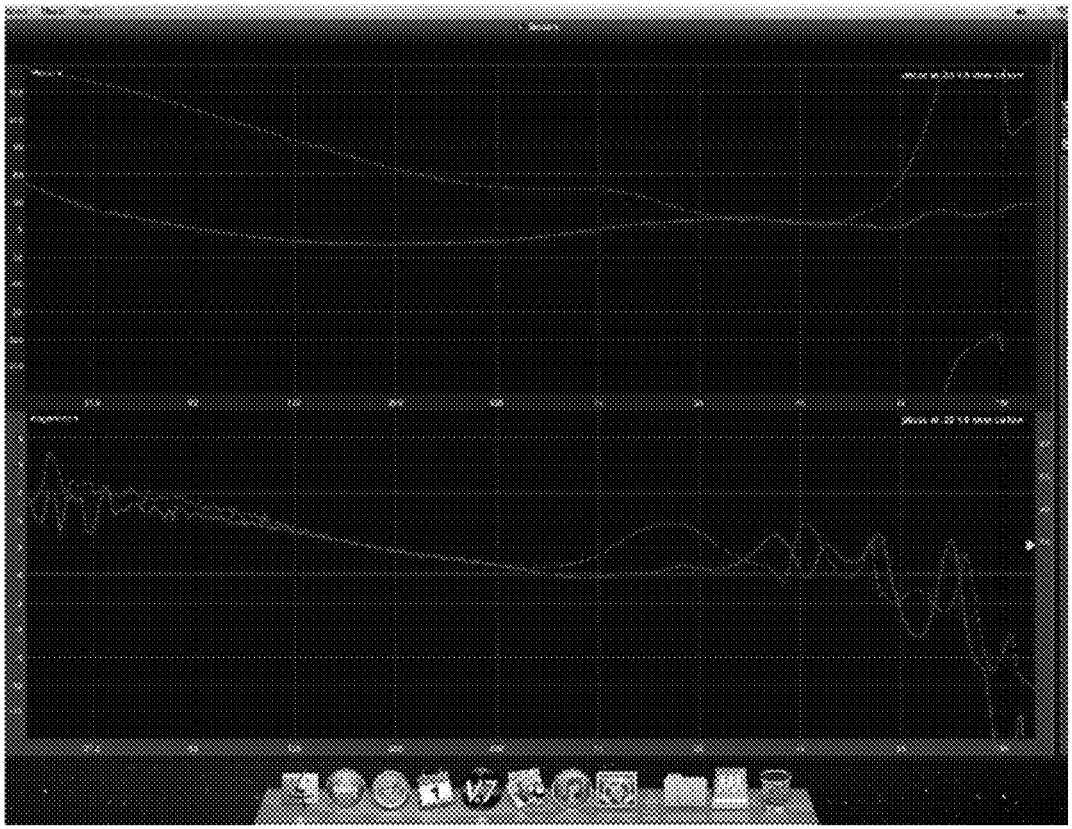
FIG. 7 is an exemplary graph of a phase corrected response of the system in FIG. 6.

FIG. 7 illustrates an example of the phase corrected response of the system 10. The red line in the upper graph is the phase corrected response compared to an uncorrected response in the lower graph.

Figure 8:
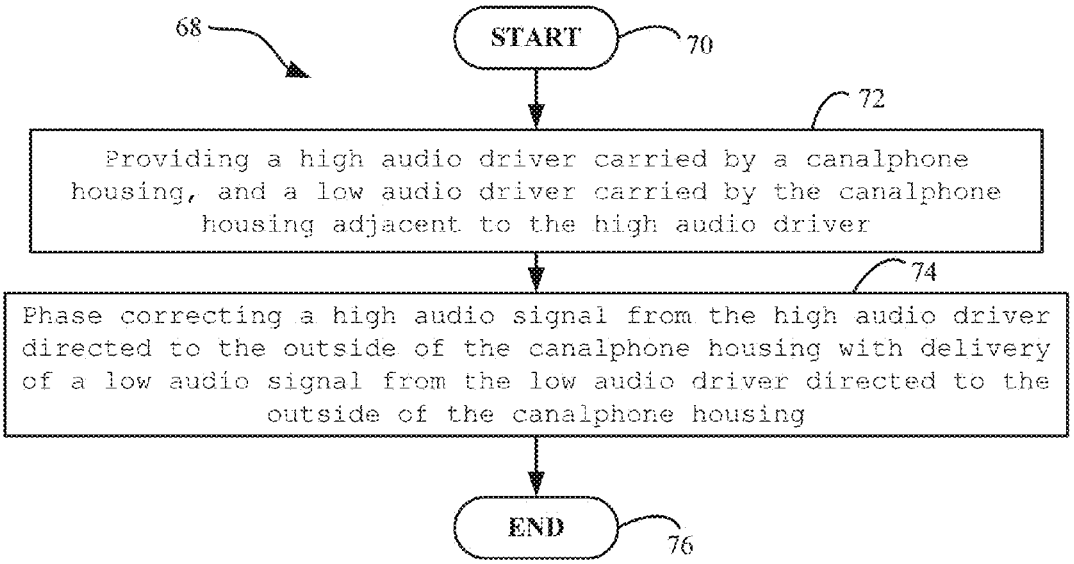
FIG. 8 is a flowchart illustrating other method aspects according to the embodiments.

Another aspect of the embodiments is another method, which is now described with reference to flowchart 68 of FIG. 8. The method begins at Block 70 and may include providing a high audio driver carried by a canalphone housing, and a low audio driver carried by the canalphone housing adjacent to the high audio driver at Block 72. The method may also include phase correcting a high audio signal from the high audio driver directed to the outside of the canalphone housing with delivery of a low audio signal from the low audio driver directed to the outside of the canalphone housing at Block 74. The method ends at Block 76.

Figure 9:
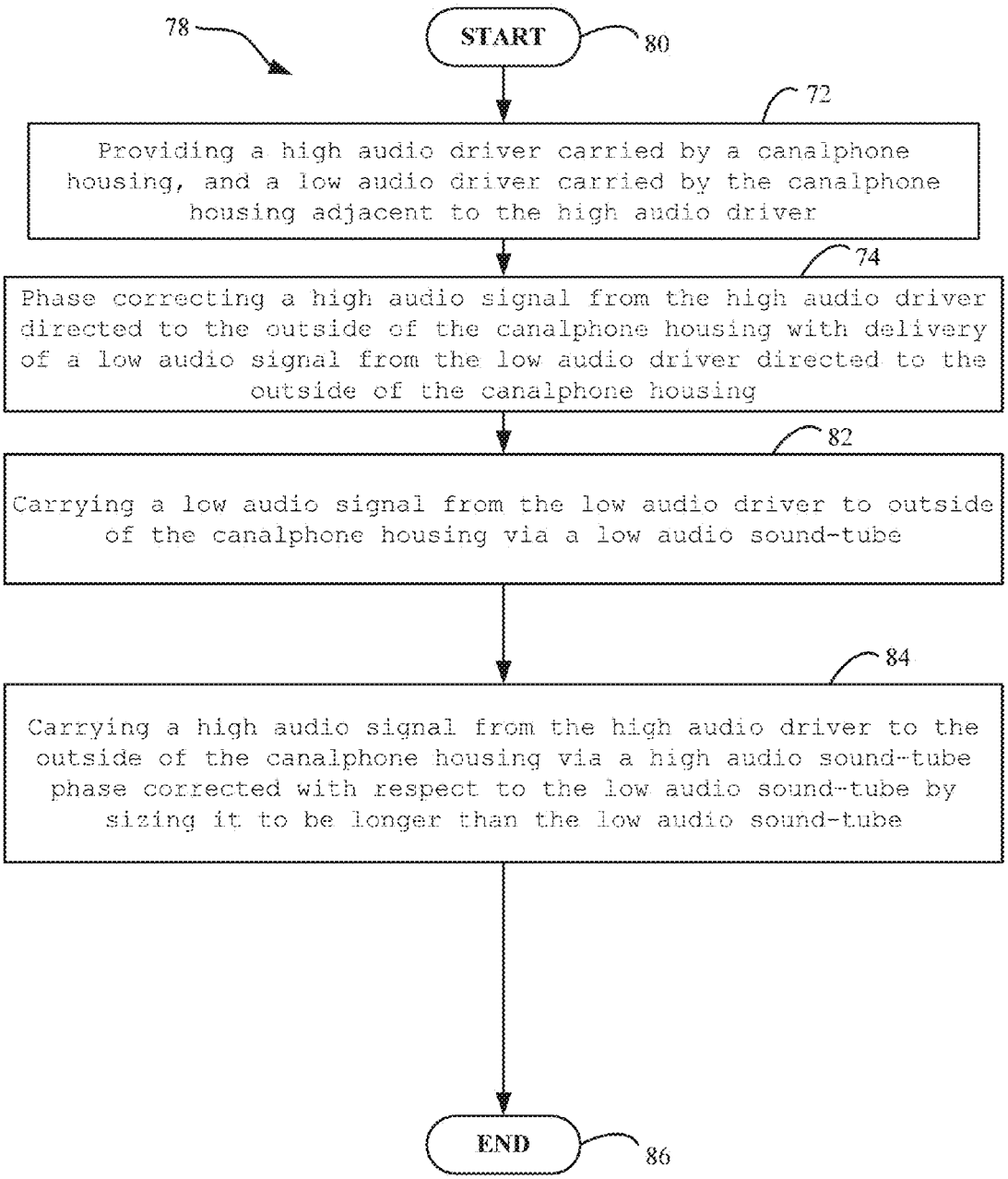
FIG. 9 is a flowchart illustrating method aspects according to the method of FIG. 8.

In another method embodiment, which is now described with reference to flowchart 78 of FIG. 9, the method begins at Block 80. The method may include the steps of FIG. 8 at Blocks 72 and 74. The method may further include carrying a low audio signal from the low audio driver to outside of the canalphone housing via a low audio sound-tube at Block 82. The method may additionally include carrying a high audio signal from the high audio driver to the outside of the canalphone housing via a high audio sound-tube phase corrected with respect to the low audio sound-tube by sizing it to be longer than the low audio sound-tube at Block 84. The method ends at Block 86.

Figure 10:
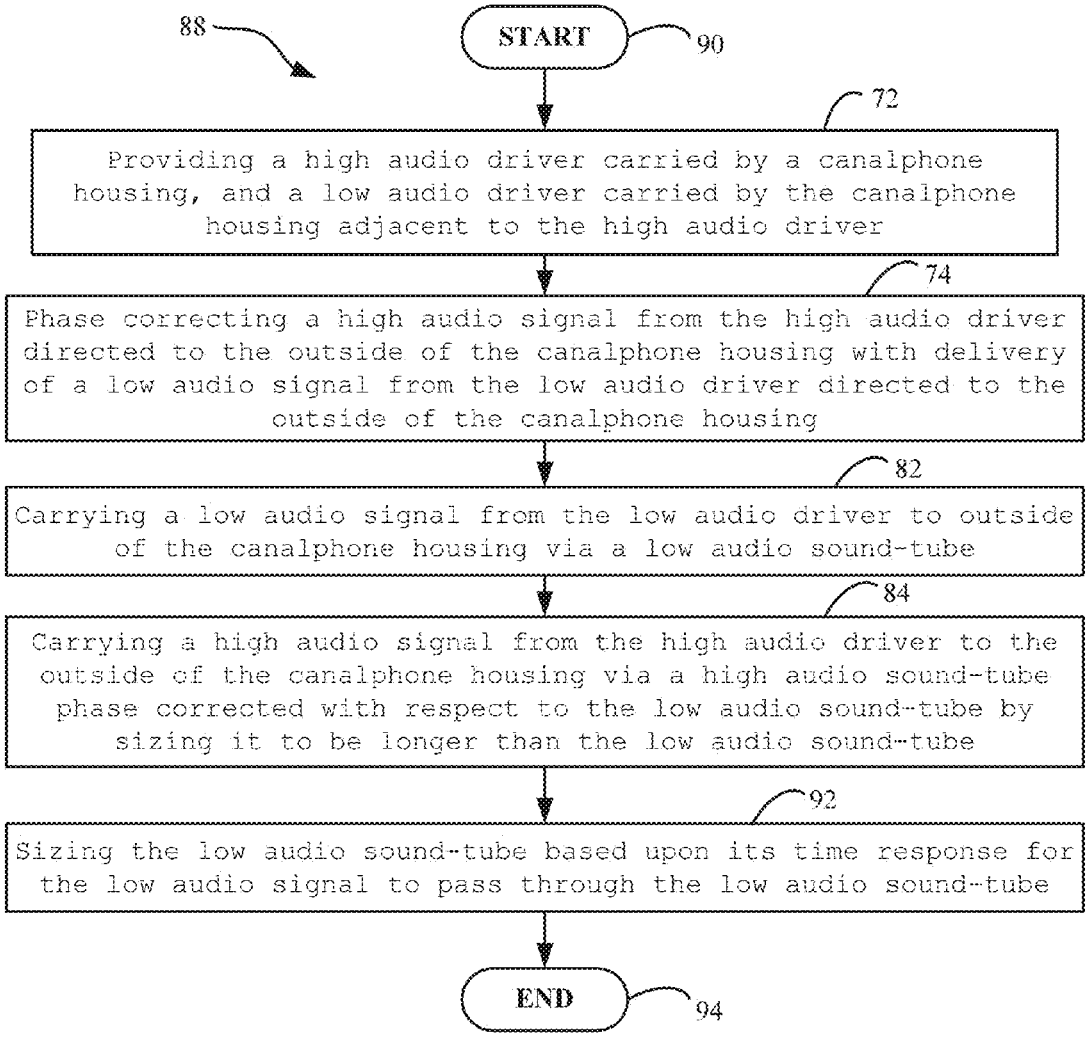
FIG. 10 is a flowchart illustrating method aspects according to the method of FIG. 9.

In another method embodiment, which is now described with reference to flowchart 88 of FIG. 10, the method begins at Block 90. The method may include the steps of FIG. 9 at Blocks 72, 74, 82, and 84. The method may also include sizing the low audio sound-tube based upon its time response for the low audio signal to pass through the low audio sound-tube at Block 92. The method ends at Block 94.

Figure 11:
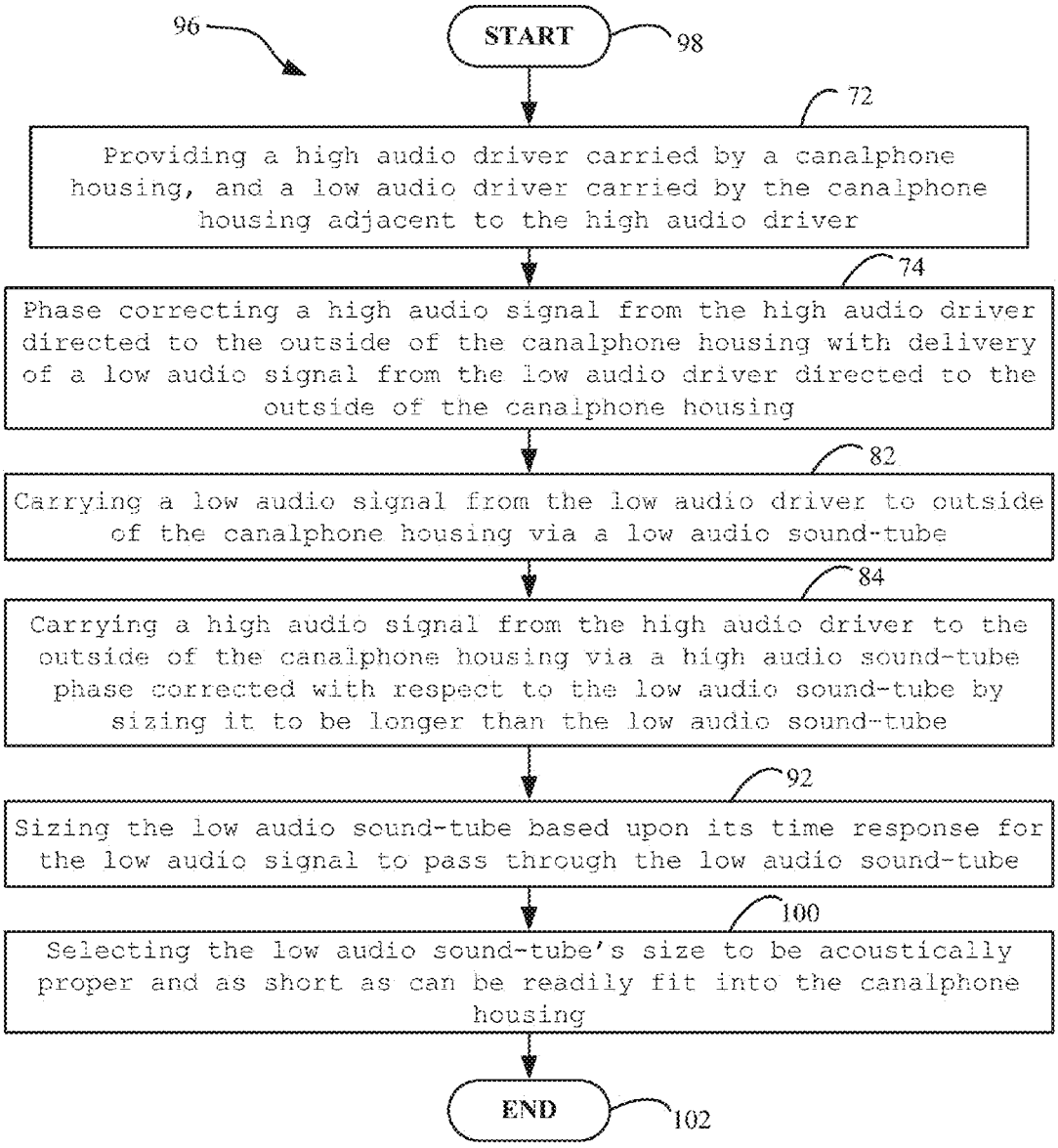
FIG. 11 is a flowchart illustrating method aspects according to the method of FIG. 10.

In another method embodiment, which is now described with reference to flowchart 96 of FIG. 11, the method begins at Block 98. The method may include the steps of FIG. 10 at Blocks 72, 74, 82, 84, and 92. The method may also include selecting the low audio sound-tube's size to be acoustically proper and as short as can be readily fit into the canalphone housing at Block 100. The method ends at Block 102.

Acoustically proper means that the audio sound tube does not promote distortion due to its length. As short as can be readily fit into the canalphone housing 12 refers to the fact that the physical dimensions of the canalphone housing creates placement issues with regards to the low audio driver 22 and the other system 10 components such as the high audio driver 20 and respective sound tubes.

Figure 12:
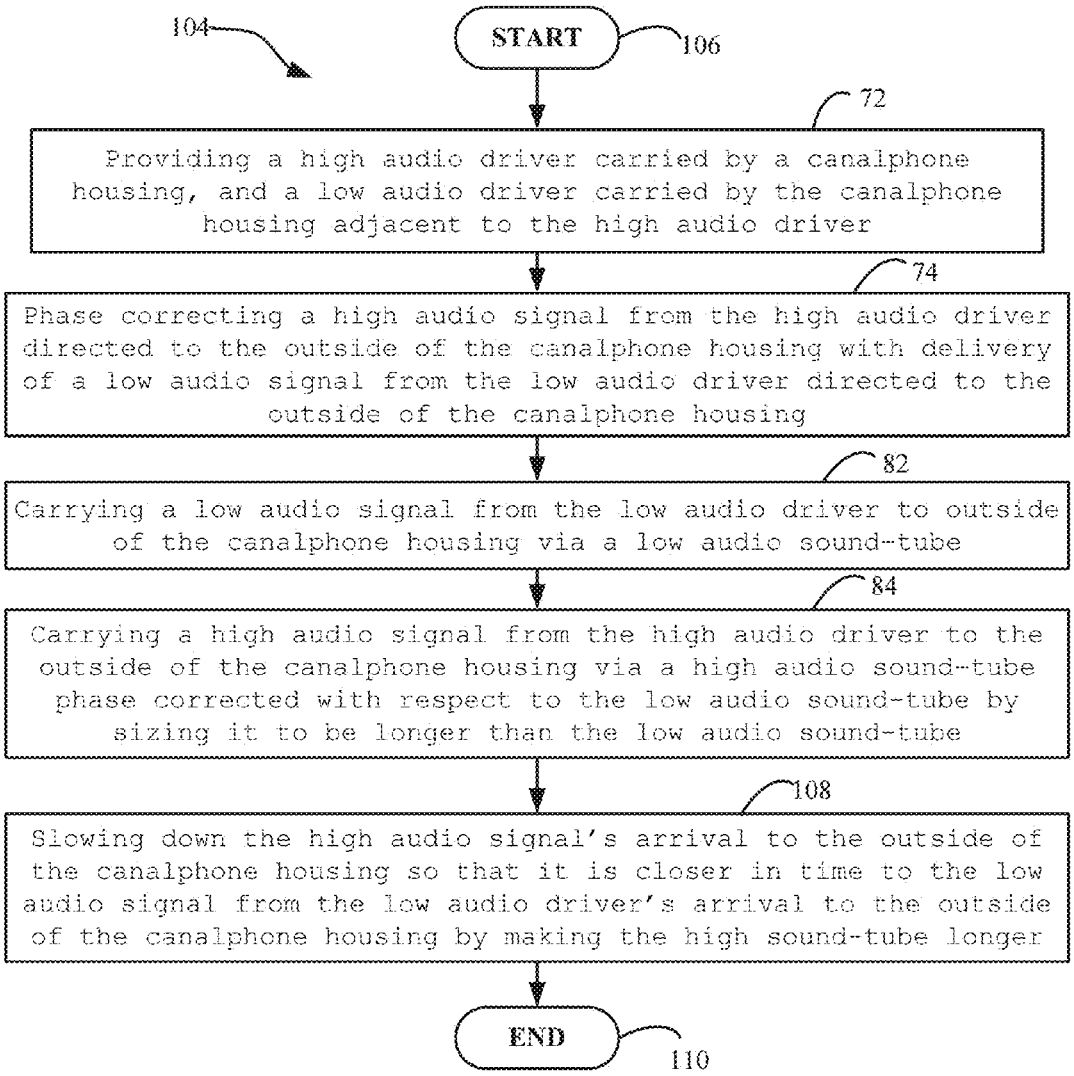
FIG. 12 is a flowchart illustrating method aspects according to the method of FIG. 9.

In another method embodiment, which is now described with reference to flowchart 104 of FIG. 12, the method begins at Block 108. The method may include the steps of FIG. 9 at Blocks 72, 74, 82, and 84. The method may also include slowing down the high audio signal's arrival to the outside of the canalphone housing so that it is closer in time to the low audio signal from the low audio driver's arrival to the outside of the canalphone housing by making the high sound-tube longer at Block 108. The method ends at Block 110.

Figure 13:
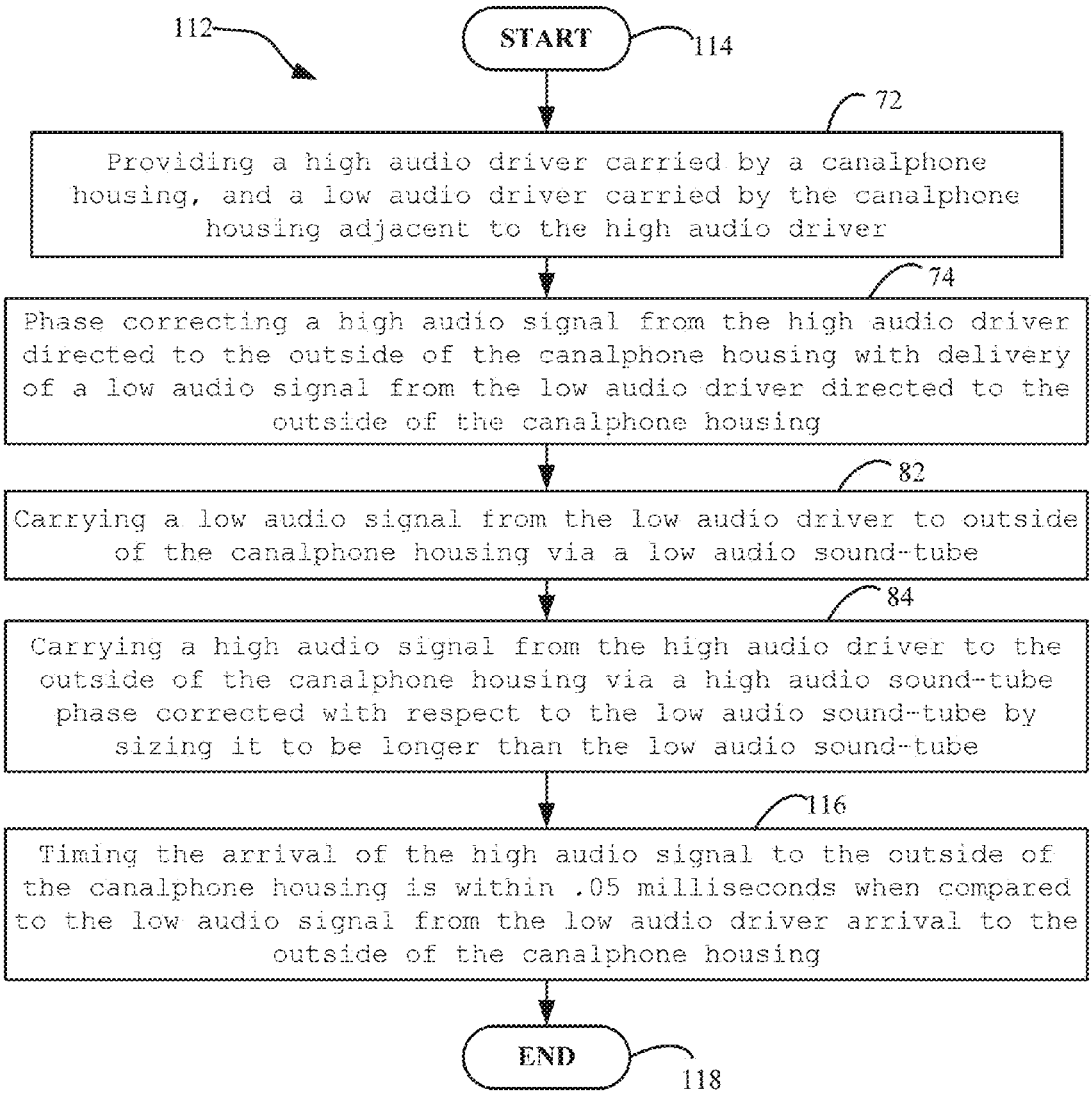
FIG. 13 is a flowchart illustrating method aspects according to the method of FIG. 9.

In another method embodiment, which is now described with reference to flowchart 112 of FIG. 13, the method begins at Block 114. The method may include the steps of FIG. 9 at Blocks 72, 74, 82, and 84. The method may also include timing the arrival of the high audio signal to the outside of the canalphone housing is within 0.05 milliseconds when compared to the low audio signal from the low audio driver arrival to the outside of the canalphone housing at Block 116. The method ends at Block 118.

Figure 14:
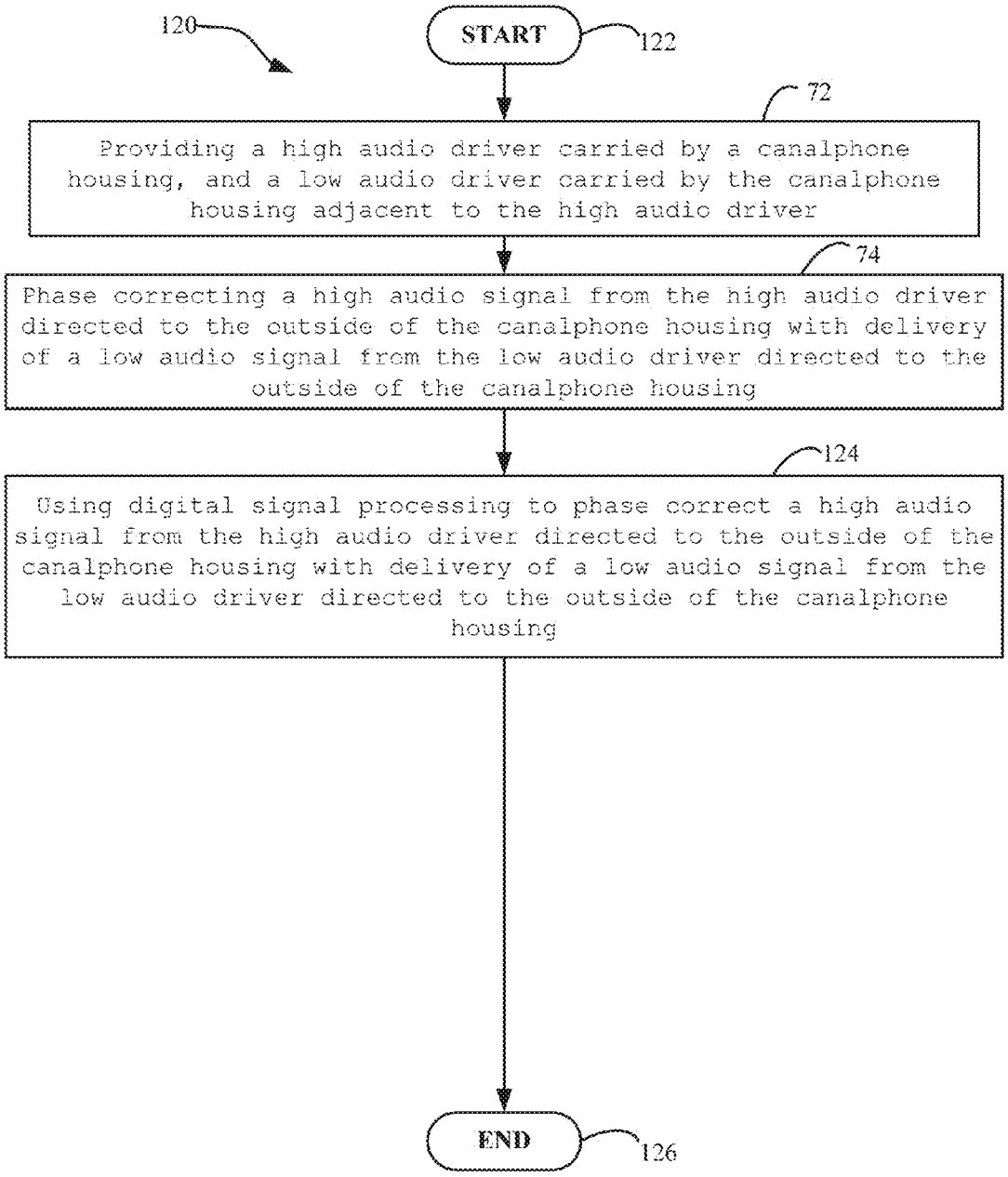
FIG. 14 is a flowchart illustrating method aspects according to the method of FIG. 8.

In another method embodiment, which is now described with reference to flowchart 120 of FIG. 14, the method begins at Block 122. The method may include the steps of FIG. 8 at Blocks 72 and 74. The method may further include using digital signal processing to phase correct a high audio signal from the high audio driver directed to the outside of the canalphone housing with delivery of a low audio signal from the low audio driver directed to the outside of the canalphone housing at Block 124. The method ends at Block 126.

Figure 15:
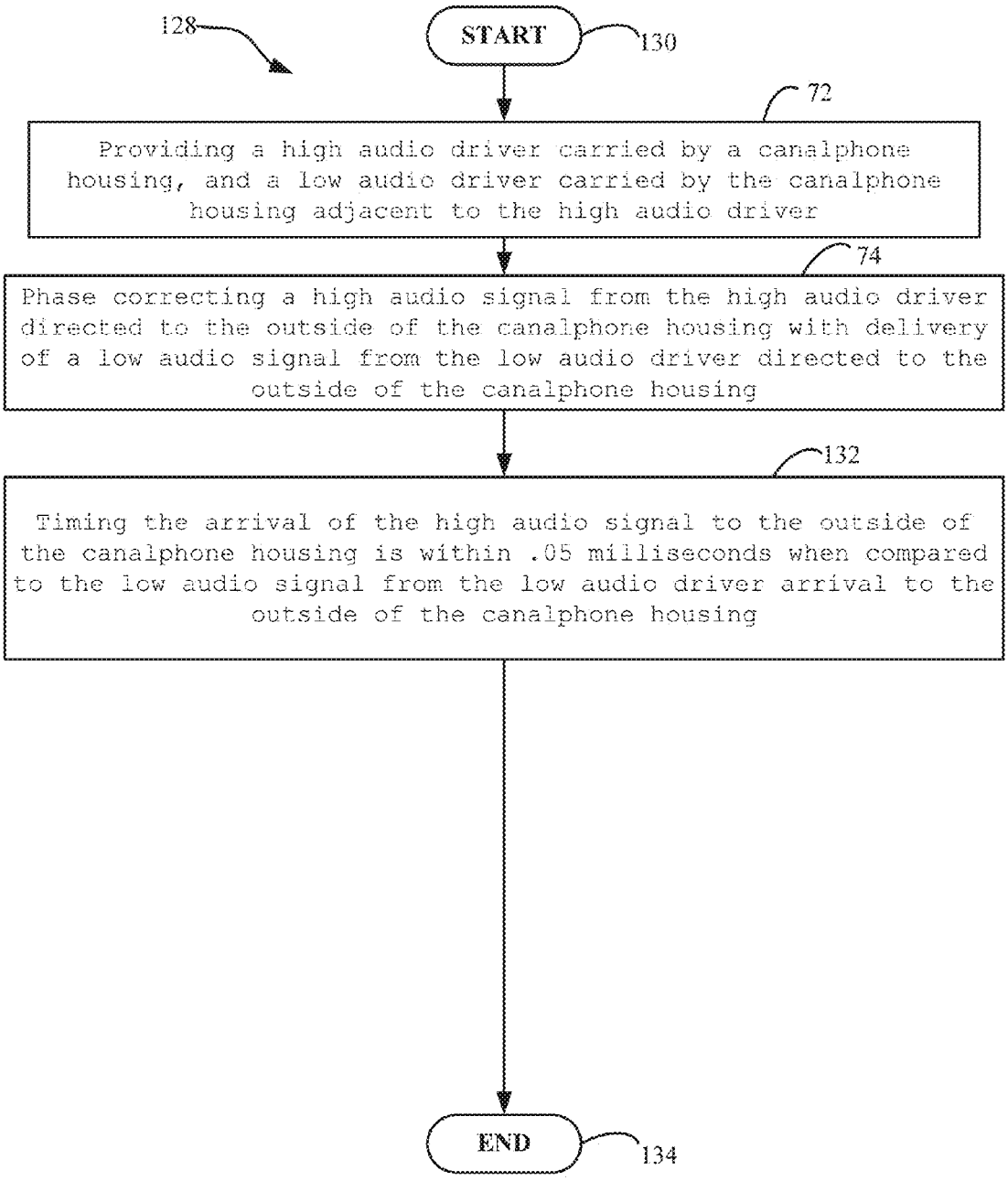
FIG. 15 is a flowchart illustrating method aspects according to the method of FIG. 8.

In another method embodiment, which is now described with reference to flowchart 128 of FIG. 15, the method begins at Block 130. The method may include the steps of FIG. 8 at Blocks 72 and 74. The method may further include timing the arrival of the high audio signal to the outside of the canalphone housing is within 0.05 milliseconds when compared to the low audio signal from the low audio driver arrival to the outside of the canalphone housing at Block 132. The method ends at Block 134.

Figure 16:
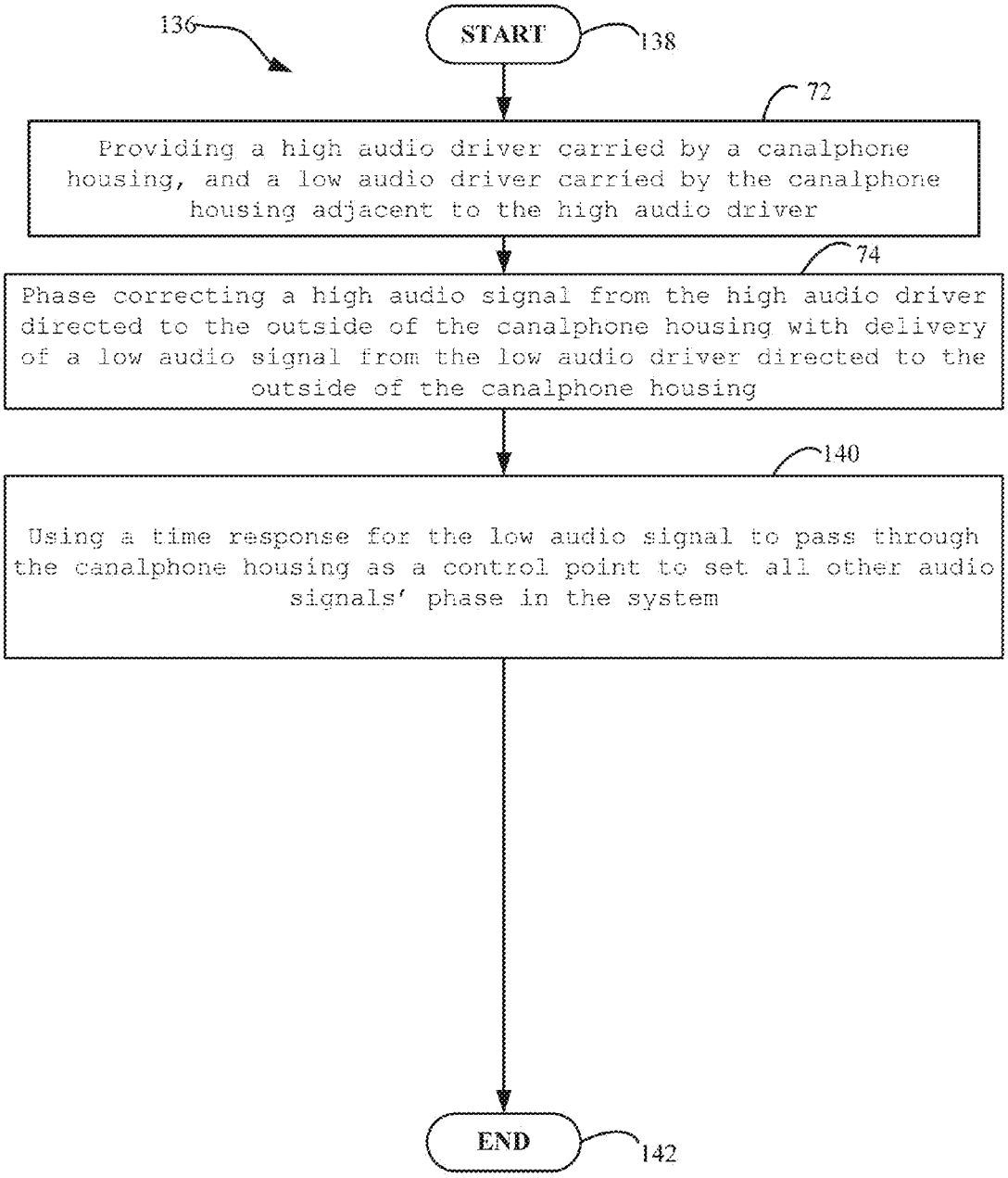
FIG. 16 is a flowchart illustrating method aspects according to the method of FIG. 8.

In another method embodiment, which is now described with reference to flowchart 136 of FIG. 16, the method begins at Block 138. The method may include the steps of FIG. 8 at Blocks 72 and 74. The method may further include using a time response for the low audio signal to pass through the canalphone housing as a control point to set all other audio signals' phase in the system at Block 140. The method ends at Block 142.

Figure 17:
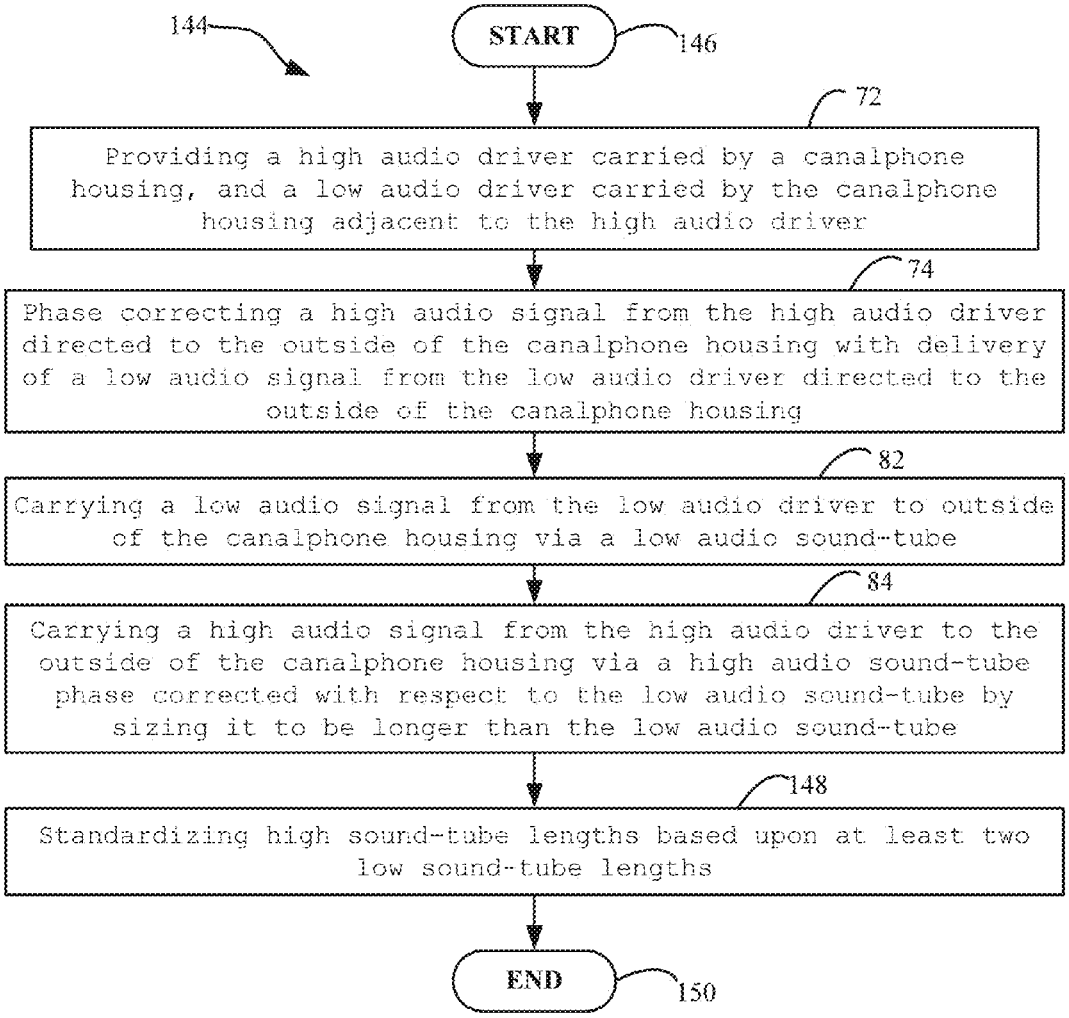
FIG. 17 is a flowchart illustrating method aspects according to the method of FIG. 9.

In another method embodiment, which is now described with reference to flowchart 144 of FIG. 17, the method begins at Block 146. The method may include the steps of FIG. 9 at Blocks 72, 74, 82, and 84. The method may also include standardizing high sound-tube lengths based upon at least two low sound-tube lengths at Block 148. The method ends at Block 150.

Figure 18:
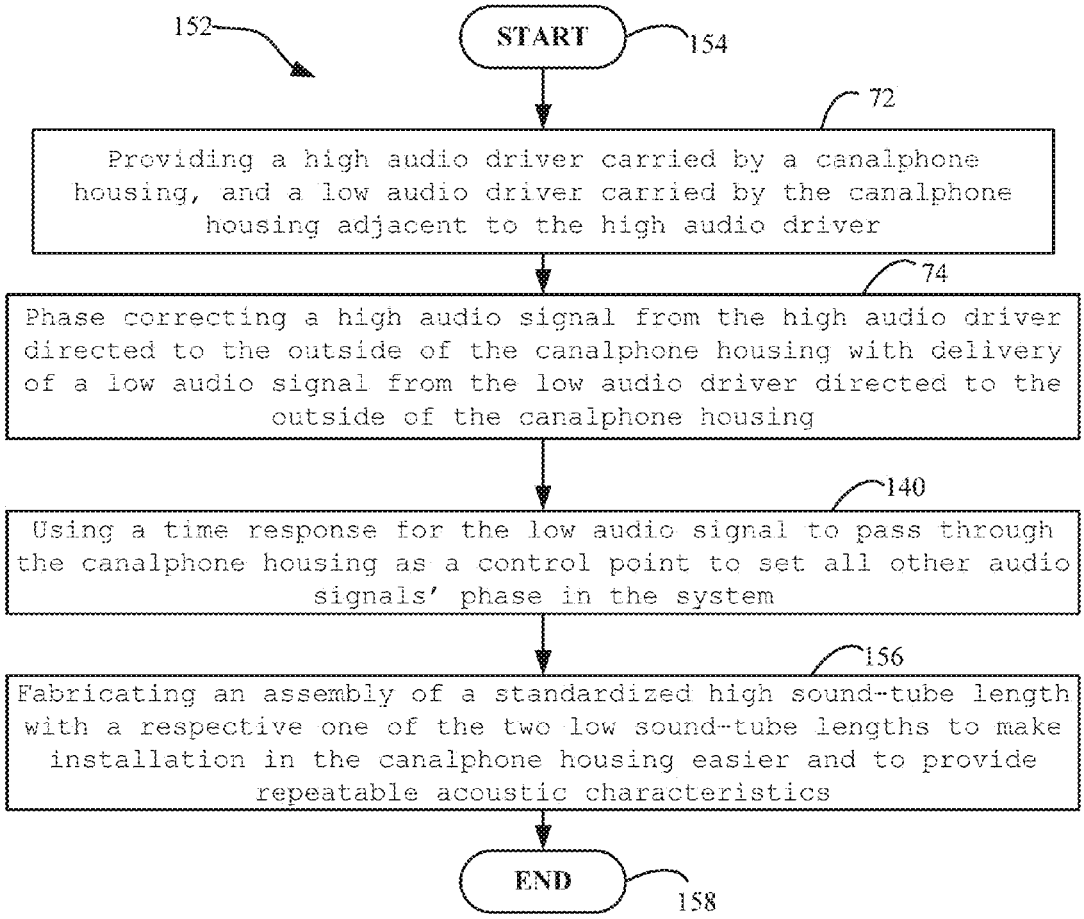
FIG. 18 is a flowchart illustrating method aspects according to the method of FIG. 16.

In another method embodiment, which is now described with reference to flowchart 152 of FIG. 18, the method begins at Block 154. The method may include the steps of FIG. 16 at Blocks 72, 74, and 140. The method may also include fabricating an assembly of a standardized high sound-tube length with a respective one of the two low sound-tube lengths to make installation in the canalphone housing easier and to provide repeatable acoustic characteristics at Block 156. The method ends at Block 158.

Figure 19:
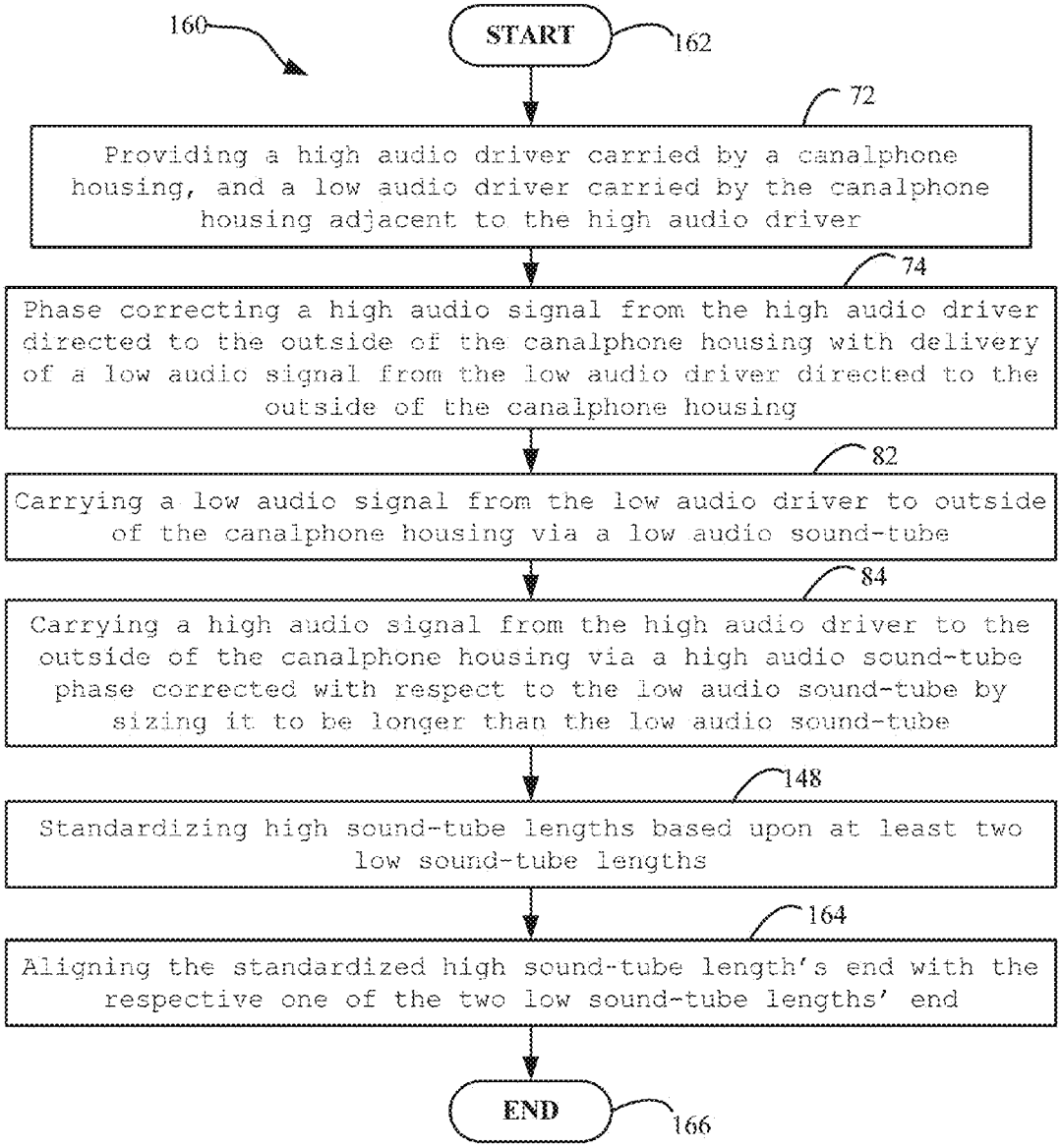
FIG. 19 is a flowchart illustrating method aspects according to the method of FIG. 17.

In another method embodiment, which is now described with reference to flowchart 160 of FIG. 19, the method begins at Block 162. The method may include the steps of FIG. 17 at Blocks 72, 74, 82, 84, and 148. The method may also include aligning the standardized high sound-tube length's end with the respective one of the two low sound-tube lengths' end at Block 164. The method ends at Block 166.

Another aspect of the embodiments are computer readable program codes coupled to tangible media to provide canalphone phase correction. The computer readable program codes may be configured to cause the program to provide a high audio driver carried by a canalphone housing, and a low audio driver carried by the canalphone housing adjacent to the high audio driver. The computer readable program codes may also phase correct a high audio signal from the high audio driver to the outside of the canalphone housing with delivery of a low audio signal from the low audio driver to the outside of the canalphone housing.

The computer readable program codes may further phase correct a high audio signal from the high audio driver to the outside of the canalphone housing with delivery of a low audio signal from the low audio driver to the outside of the canalphone housing. The computer readable program codes may additionally use a time response for the low audio signal to pass through the canalphone housing as a control point to set all other audio signals' phase in the system.

According to one embodiment, a canalphone system 10 includes a canalphone housing 12, and a low frequency sound bore 16 to carry a low frequency signal to the canalphone housing's outside. The system 10 also includes a high frequency sound bore 14 to carry a high frequency signal to the canalphone housing's outside, and the low frequency sound bore's 16 length and/or the high frequency sound bore's length is determined based upon being acoustically proper as well as a user's (not shown) ear canal size.

In one embodiment, the system 10 further includes the low frequency sound bore's 16 length and/or the high frequency sound bore's 14 length being extended to reduce a respective low frequency sound bore's diameter and/or high frequency sound bore's diameter. In another embodiment, the low frequency sound bore 16 is sized based upon the low frequency signal's time response to pass through the low frequency sound bore.

In one embodiment, the high frequency sound bore 14 is longer to slow down the high frequency signal's arrival to the outside of the canalphone housing 12 so that it is closer in time to the low frequency signal's arrival to the outside of the canalphone housing. In another embodiment, the low frequency sound bore's 16 diameter and/or the high frequency sound bore's diameter 14 is varied to fit a respective small, medium, and large canalphone housing.

In one embodiment, the low frequency sound bore 16 and the high frequency sound bore 14 are joined as a single unit 15. In another embodiment, the single unit 15 is positioned at an angle between 30 degrees and 65 degrees with respect to a high acoustical driver 20 and a low acoustical driver 22. In another embodiment, the system 10 also includes a mid-frequency sound bore 25 that is sized between the low frequency sound bore 16 and the high frequency sound bore 14.

Figure 20:
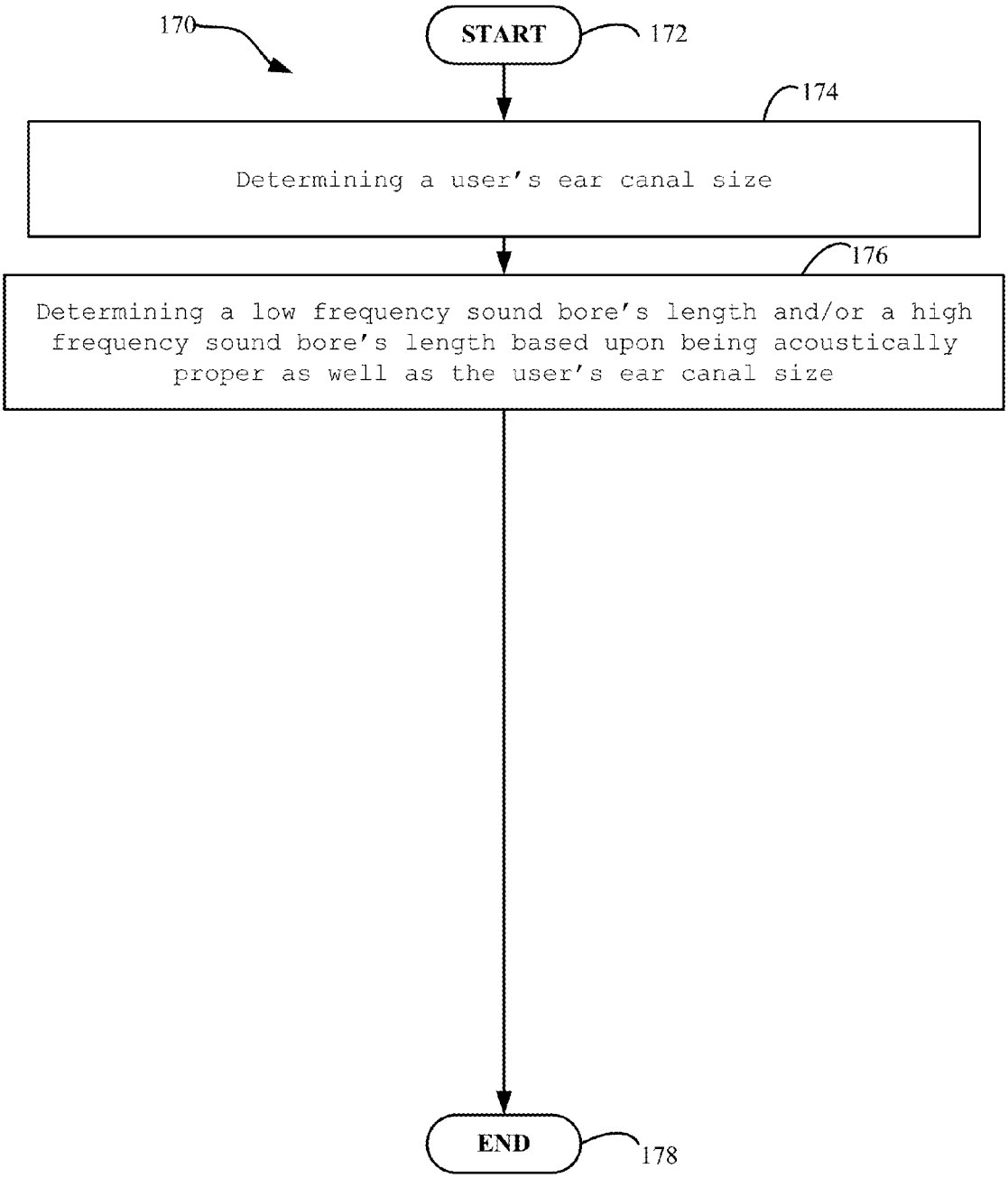
FIG. 20 is a flowchart illustrating other method aspects according to the embodiments.

Another aspect of the embodiments is a method, which is now described with reference to flowchart 170 of FIG. 20. The method begins at Block 172 and may include determining a user's ear canal size at Block 174. The method may also include determining a low frequency sound bore's length and/or a high frequency sound bore's length based upon being acoustically proper as well as the user's ear canal size at Block 176. The method ends at Block 178.

Figure 21:
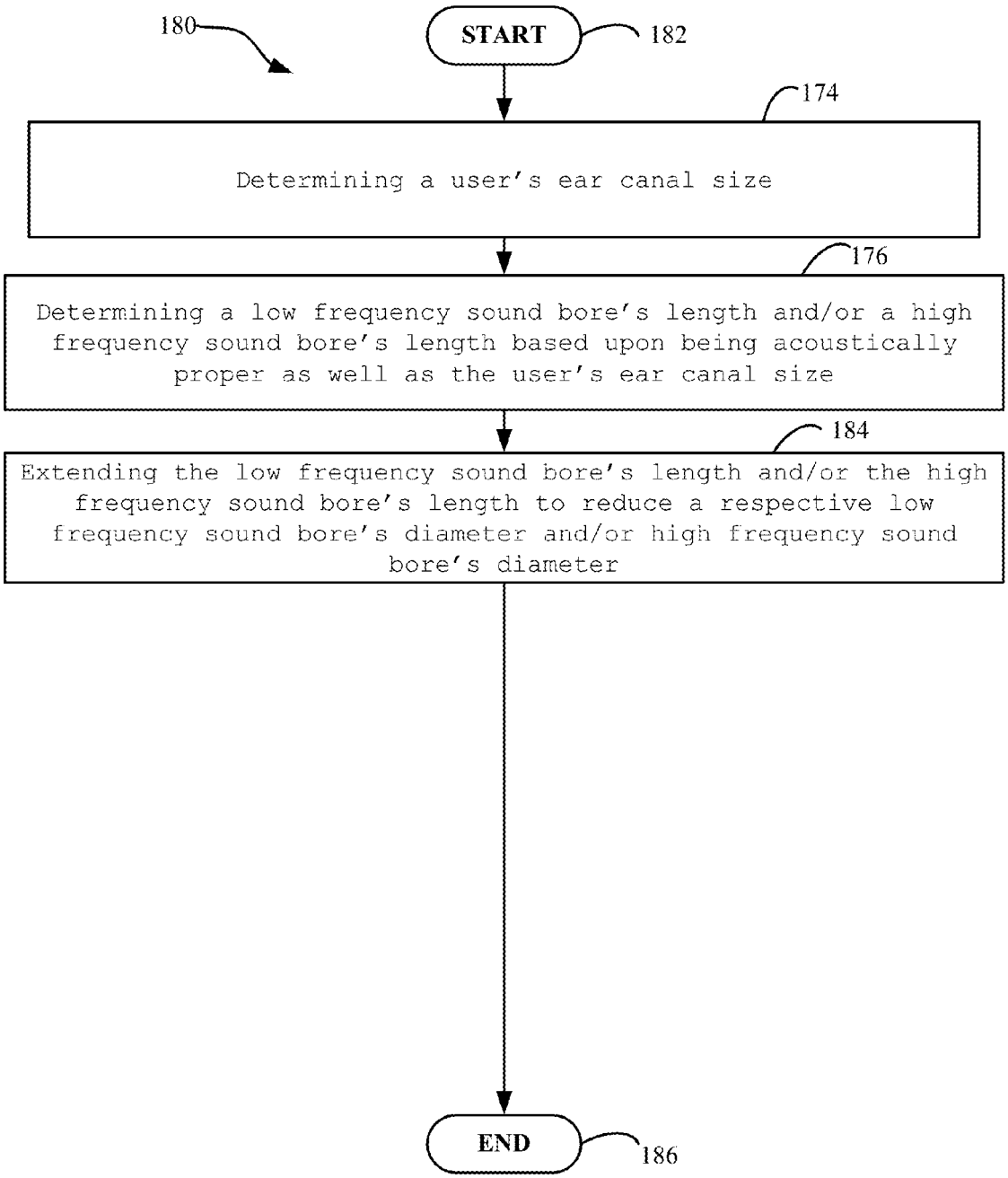
FIG. 21 is a flowchart illustrating method aspects according to the method of FIG. 20.

In another method embodiment, which is now described with reference to flowchart 180 of FIG. 21, the method begins at Block 182. The method may include the steps of FIG. 20 at Blocks 174 and 176. The method may further include extending the low frequency sound bore's length and/or the high frequency sound bore's length to reduce a respective low frequency sound bore's diameter and/or high frequency sound bore's diameter at Block 184. The method ends at Block 186.

Figure 22:
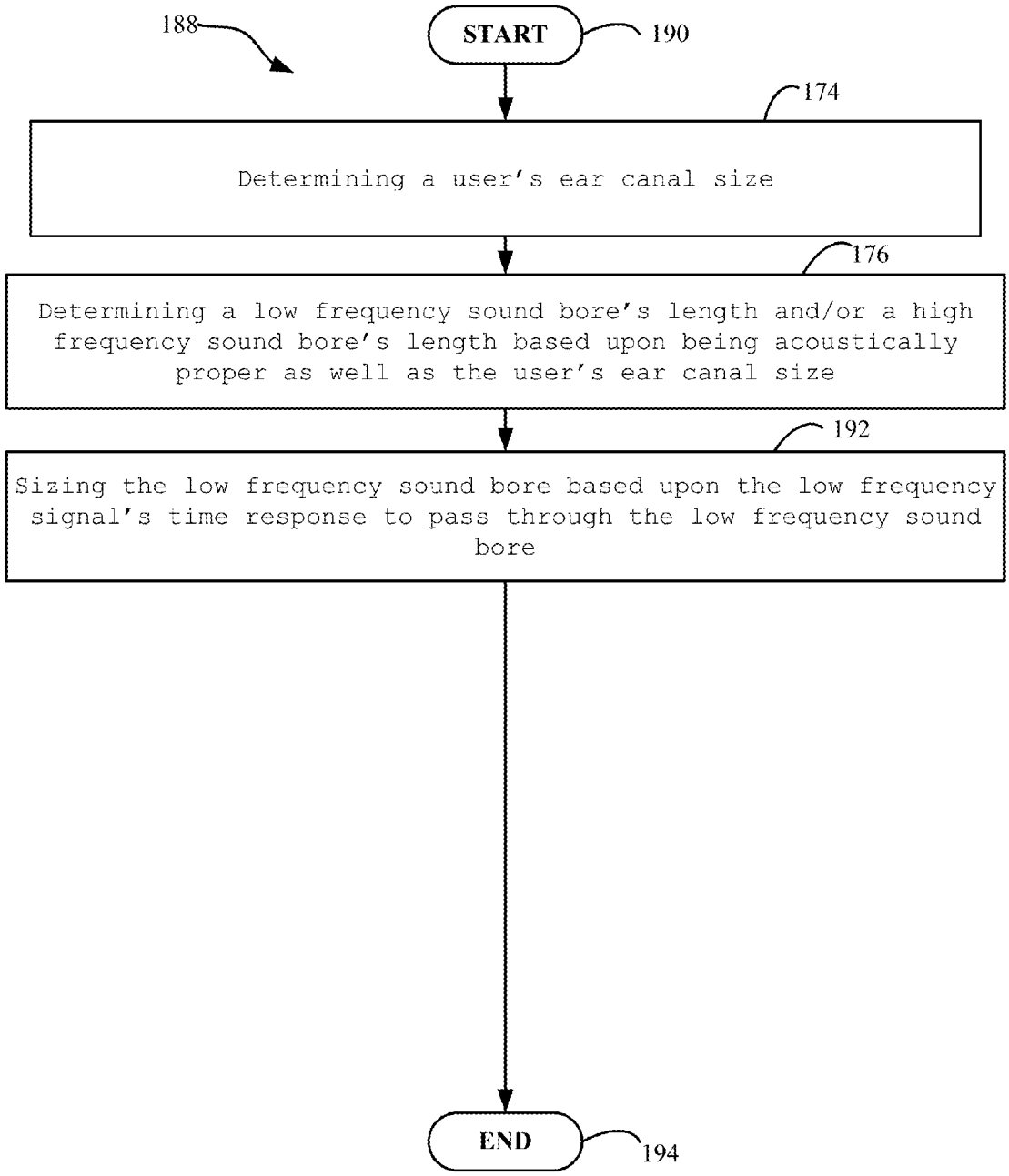
FIG. 22 is a flowchart illustrating method aspects according to the method of FIG. 20.

In another method embodiment, which is now described with reference to flowchart 188 of FIG. 22, the method begins at Block 190. The method may include the steps of FIG. 20 at Blocks 174 and 176. The method may further include sizing the low frequency sound bore based upon the low frequency signal's time response to pass through the low frequency sound bore at Block 192. The method ends at Block 194.

Figure 23:
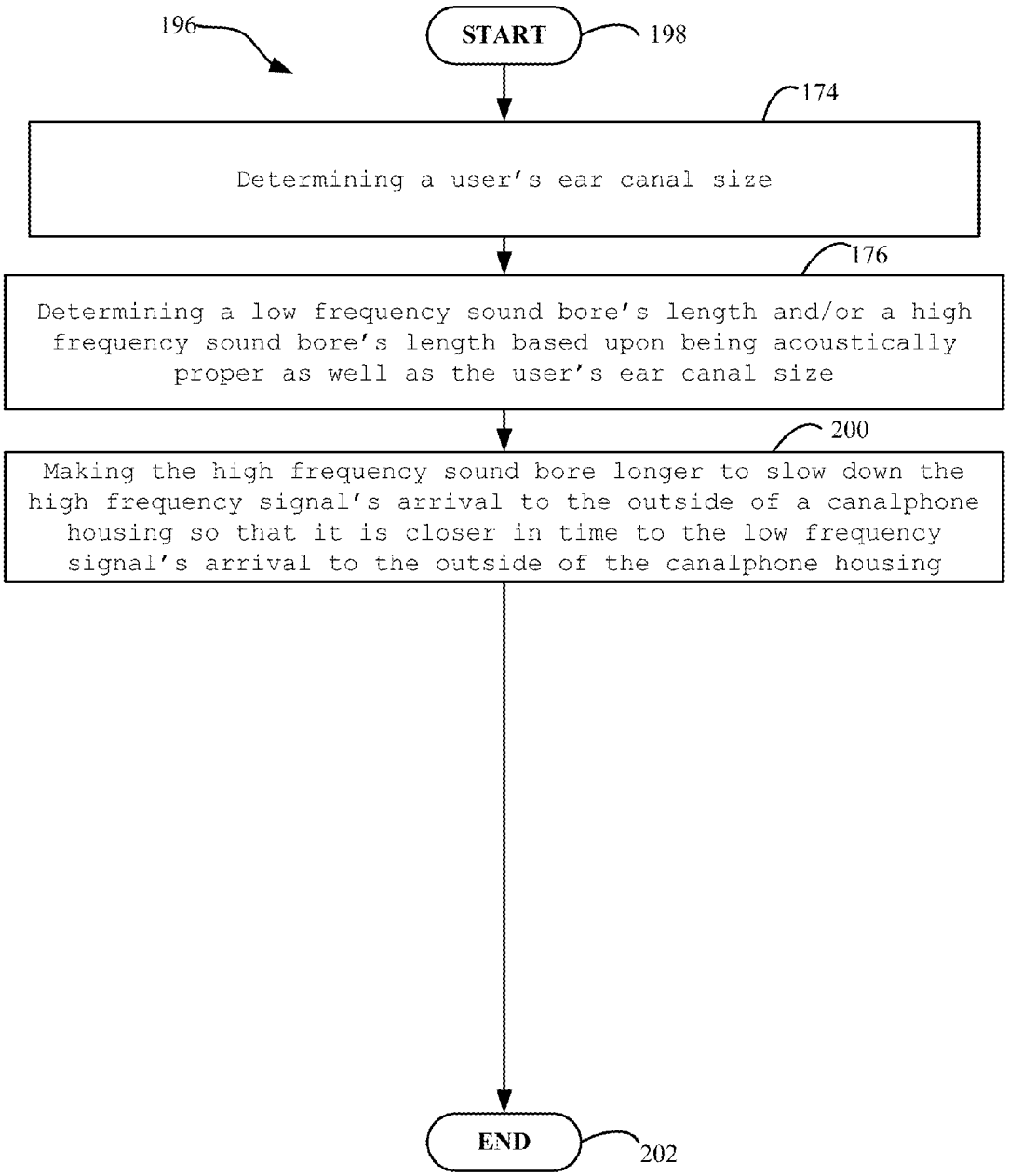
FIG. 23 is a flowchart illustrating method aspects according to the method of FIG. 20.

In another method embodiment, which is now described with reference to flowchart 196 of FIG. 23, the method begins at Block 198. The method may include the steps of FIG. 20 at Blocks 174 and 176. The method may further include making the high frequency sound bore longer to slow down the high frequency signal's arrival to the outside of a canalphone housing so that it is closer in time to the low frequency signal's arrival to the outside of the canalphone housing at Block 200. The method ends at Block 202.

Figure 24:
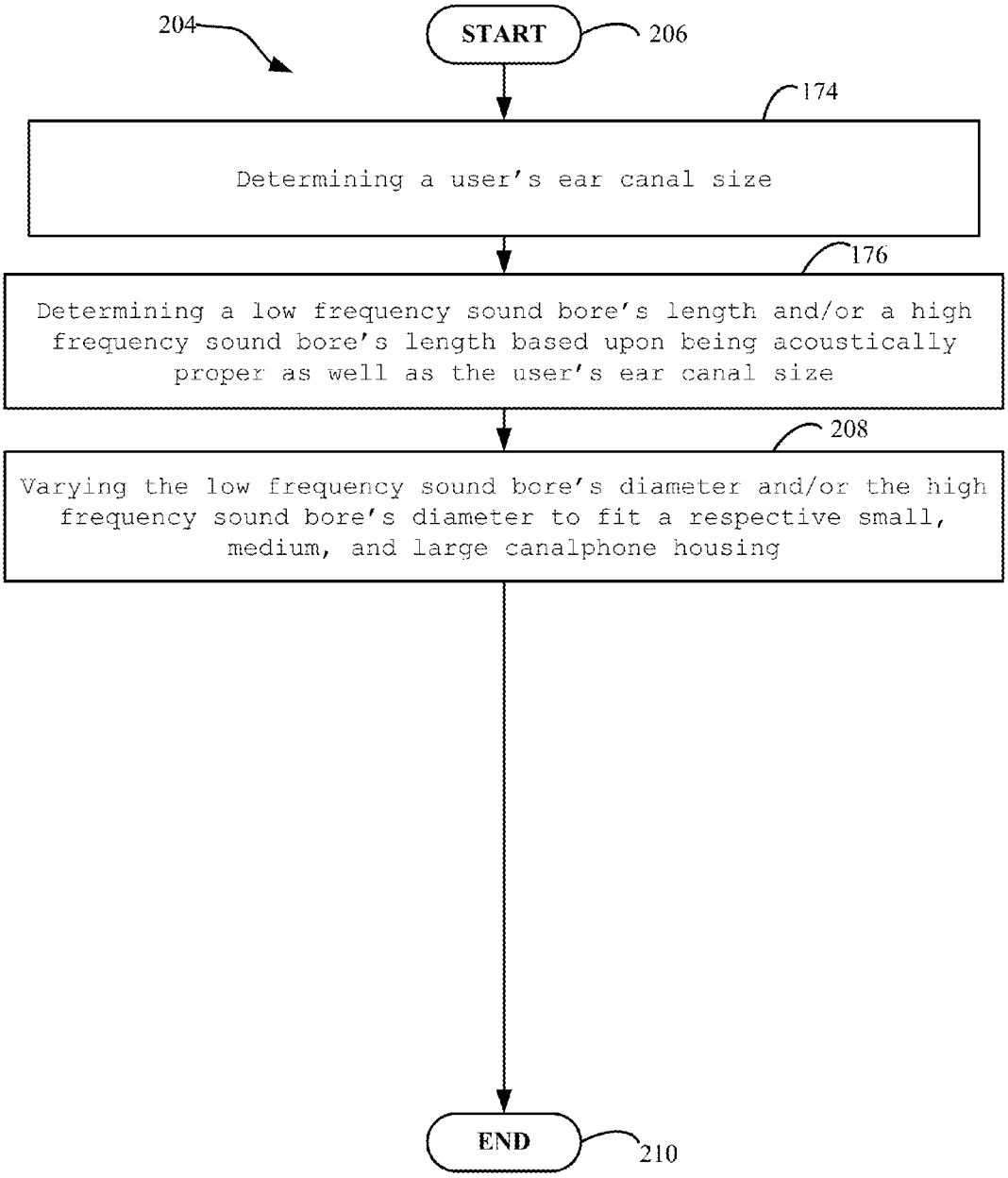
FIG. 24 is a flowchart illustrating method aspects according to the method of FIG. 20.

In another method embodiment, which is now described with reference to flowchart 204 of FIG. 24, the method begins at Block 206. The method may include the steps of FIG. 20 at Blocks 174 and 176. The method may further include varying the low frequency sound bore's diameter and/or the high frequency sound bore's diameter to fit a respective small, medium, and large canalphone housing at Block 208. The method ends at Block 210.

Figure 25:
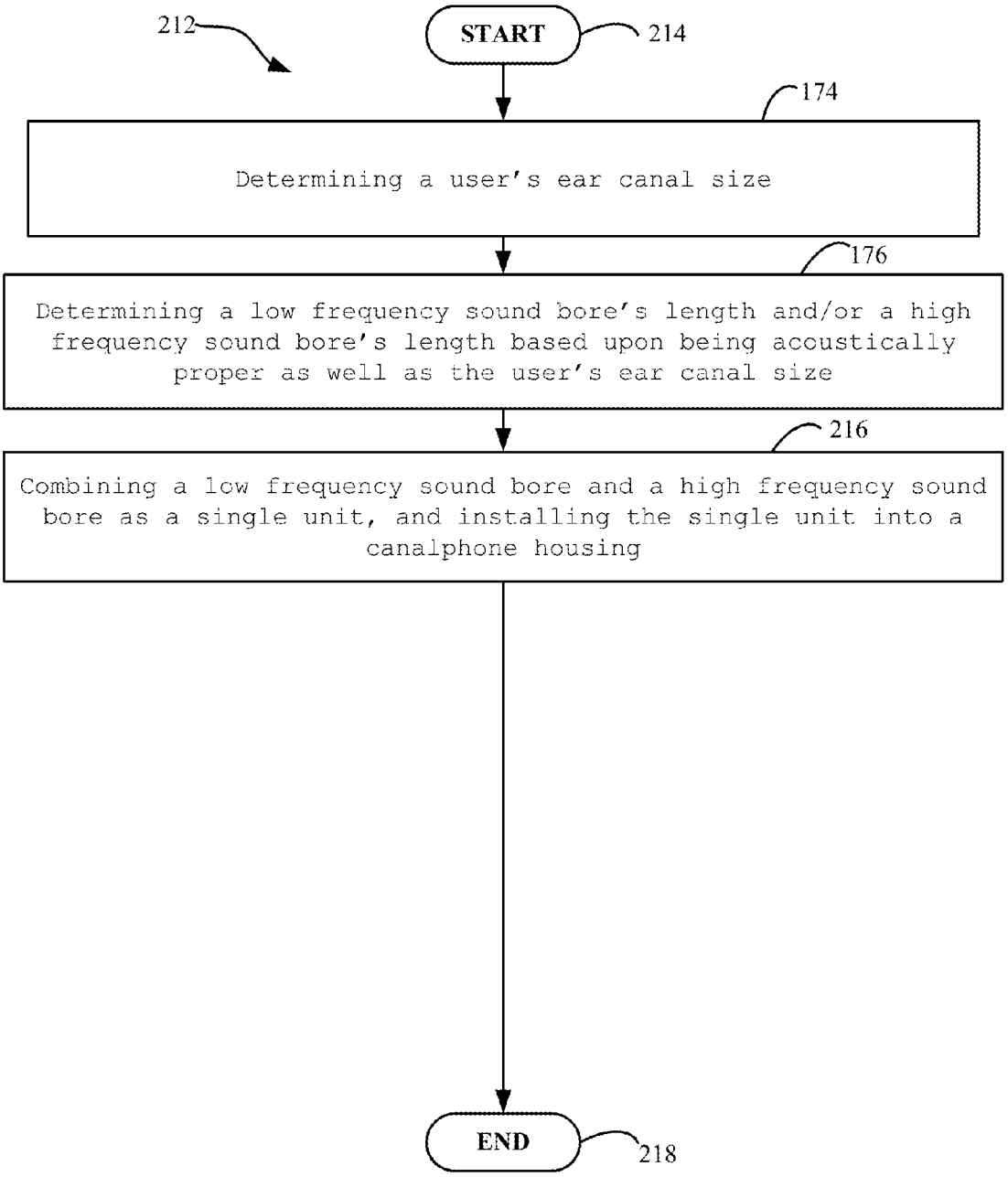
FIG. 25 is a flowchart illustrating method aspects according to the method of FIG. 20.

In another method embodiment, which is now described with reference to flowchart 212 of FIG. 25, the method begins at Block 214. The method may include the steps of FIG. 20 at Blocks 174 and 176. The method may further include combining a low frequency sound bore and a high frequency sound bore as a single unit, and installing the single unit into a canalphone housing at Block 216. The method ends at Block 218.

Figure 26:
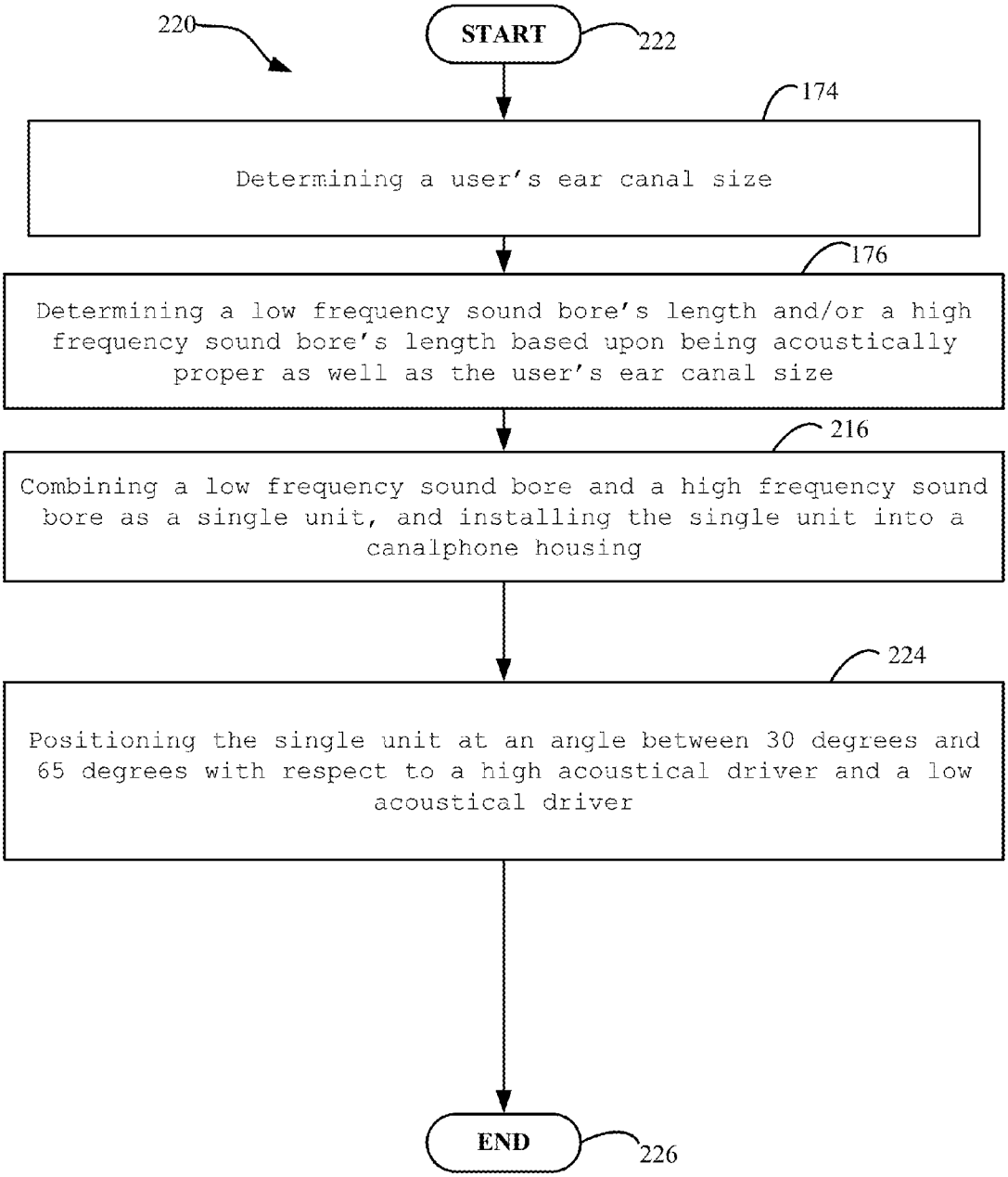
FIG. 26 is a flowchart illustrating method aspects according to the method of FIG. 25.

In another method embodiment, which is now described with reference to flowchart 220 of FIG. 26, the method begins at Block 222. The method may include the steps of FIG. 25 at Blocks 174, 176, and 216. The method may further include positioning the single unit at an angle between 30 degrees and 65 degrees with respect to a high acoustical driver and a low acoustical driver at Block 224. The method ends at Block 226.

Figure 27:
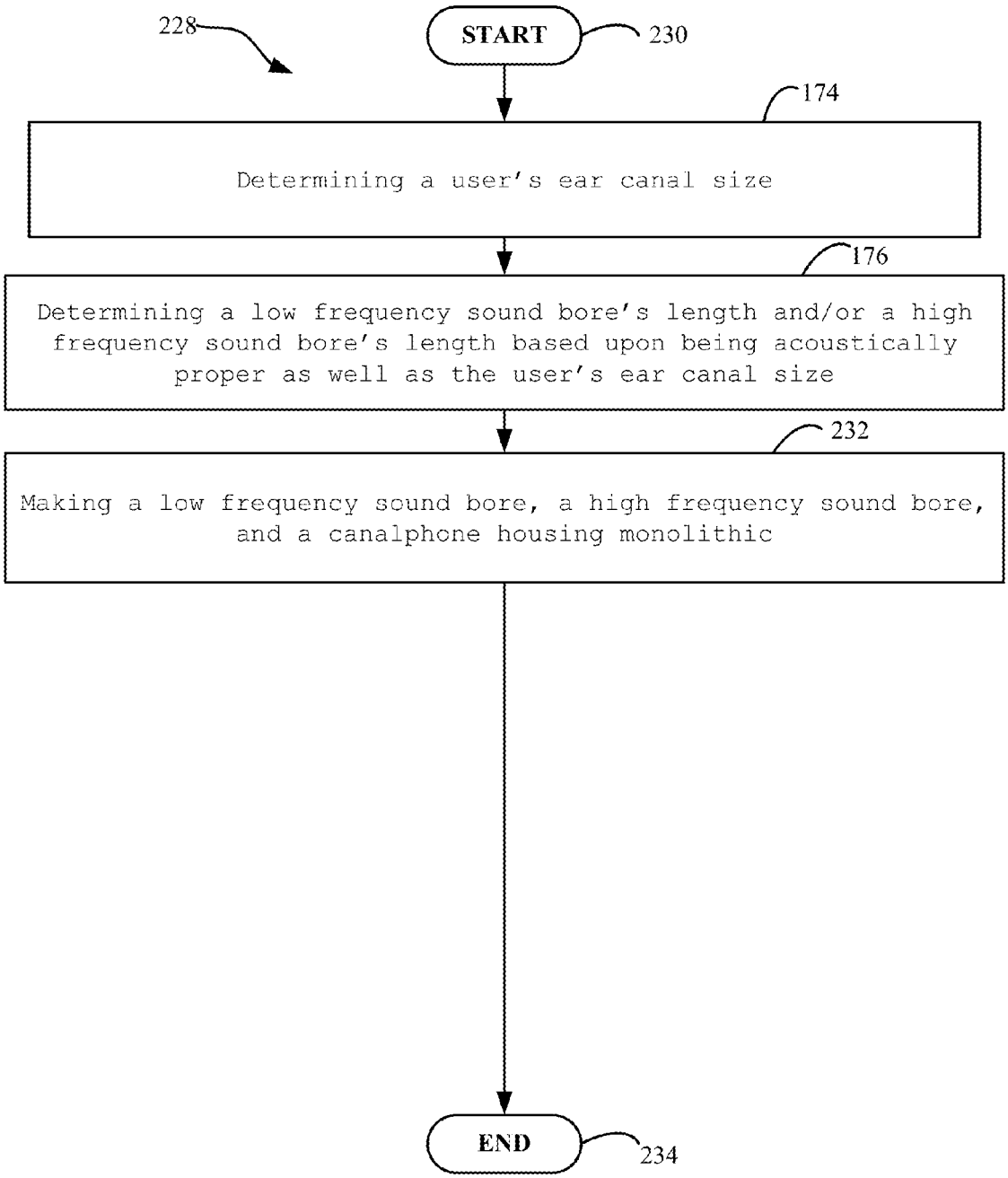
FIG. 27 is a flowchart illustrating method aspects according to the method of FIG. 20.

In another method embodiment, which is now described with reference to flowchart 228 of FIG. 27, the method begins at Block 230. The method may include the steps of FIG. 20 at Blocks 174 and 176. The method may further include making a low frequency sound bore, a high frequency sound bore, and a canalphone housing monolithic at Block 232. The method ends at Block 234.

Since a canalphone housing 12 is very small, it is very difficult to achieve any of the preceding embodiments. However, system 10 overcomes the technical hurdles of providing more components in less space, providing superior sound reproduction, and provides a user a phase corrected canalphone system.

As will be appreciated by one skilled in the art, aspects may be embodied as a system, method, and/or computer program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the embodiments may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the embodiments are described above with reference to flowchart illustrations and/or block diagrams of methods, apparatus (systems) and computer program products according to the embodiments. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the embodiments. The embodiment was chosen and described in order to best explain the principles of the embodiments and the practical application, and to enable others of ordinary skill in the art to understand the various embodiments with various modifications as are suited to the particular use contemplated.

While the preferred embodiment has been described, it will be understood that those skilled in the art, both now and in the future, may make various improvements and enhancements which fall within the scope of the claims which follow. These claims should be construed to maintain the proper protection for the embodiments first described.

What is claimed is:

1. A system comprising:

a canalphone housing;

a low frequency sound bore to carry a low frequency signal to the canalphone housing's outside; and a high frequency sound bore to carry a high frequency signal to the canalphone housing's outside, and at least one of the low frequency sound bore's length and the high frequency sound bore's length determined based upon being acoustically proper as well as a user's ear canal size.

2. The system of claim 1 wherein at least one of the low frequency sound bore's length and the high frequency sound bore's length are extended to reduce at least one of a respective low frequency sound bore's diameter and high frequency sound bore's diameter.

3. The system of claim 1 wherein the low frequency sound bore is sized based upon the low frequency signal's time response to pass through the low frequency sound bore.

4. The system of claim 3 wherein the high frequency sound bore is longer to slow down the high frequency signal's arrival to the outside of the canalphone housing so that it is closer in time to the low frequency signal's arrival to the outside of the canalphone housing.

5. The system of claim 2 wherein the at least one of the low frequency sound bore's diameter and the high frequency sound bore's diameter is varied to fit a respective small, medium, and large canalphone housing.

6. The system of claim 1 wherein the low frequency sound bore and the high frequency sound bore are joined as a single unit.

7. The system of claim 6 wherein the single unit is positioned at an angle between 30 degrees and 65 degrees with respect to a high acoustical driver and a low acoustical driver.

8. The system of claim 1 further comprising a mid-frequency sound bore sized between the low frequency sound bore and the high frequency sound bore.

9. A method comprising:

determining a user's ear canal size;

determining at least one of a low frequency sound bore's length and a high frequency sound bore's length based upon being acoustically proper as well as the user's ear canal size.

10. The method of claim 9 further comprising extending at least one of the low frequency sound bore's length and the high frequency sound bore's length to reduce at least one of a respective low frequency sound bore's diameter and high frequency sound bore's diameter.

11. The method of claim 9 further comprising sizing the low frequency sound bore based upon the low frequency signal's time response to pass through the low frequency sound bore.

12. The method of claim 9 further comprising making the high frequency sound bore longer to slow down the high frequency signal's arrival to the outside of a canalphone housing so that it is closer in time to the low frequency signal's arrival to the outside of the canalphone housing.

13. The method of claim 9 further comprising varying at least one of the low frequency sound bore's diameter and the high frequency sound bore's diameter to fit a respective small, medium, and large canalphone housing.

14. The method of claim 9 further comprising:

combining a low frequency sound bore and a high frequency sound bore as a single unit and installing the single unit into a canalphone housing.

15. The method of claim 14 further comprising positioning the single unit at an angle between 30 degrees and 65 degrees with respect to a high acoustical driver and a low acoustical driver.

16. The method of claim 9 further comprising making a low frequency sound bore, a high frequency sound bore, and a canalphone housing monolithic.

17. A system comprising:

a canalphone housing;

a low frequency sound bore to carry a low frequency signal to the canalphone housing's outside; and a high frequency sound bore to carry a high frequency signal to the canalphone housing's outside, and at least one of the low frequency sound bore's length and the high frequency sound bore's length determined based upon being acoustically proper as well as a user's ear canal size, at least one of the low frequency sound bore's length and the high frequency sound bore's length are extended to reduce at least one of a respective low frequency sound bore's diameter and high frequency sound bore's diameter, and the low frequency sound bore is sized based upon the low frequency signal's time response to pass through the low frequency sound bore.

18. The system of claim 17 wherein the high frequency sound bore is longer to slow down the high frequency signal's arrival to the outside of the canalphone housing so that it is closer in time to the low frequency signal's arrival to the outside of the canalphone housing.

19. The system of claim 17 wherein the at least one of the low frequency sound bore's diameter and the high frequency sound bore's diameter is varied to fit a respective small, medium, and large canalphone housing.

20. The system of claim 17 wherein the low frequency sound bore and the high frequency sound bore are joined as a single unit.

* * * * *